US011585151B2

(12) United States Patent
Healam et al.

(10) Patent No.: US 11,585,151 B2
(45) **Date of Patent: *Feb. 21, 2023**

(54) SELF-ADJUSTING BOTTOM BAR FOR A RETRACTABLE SCREEN

(71) Applicant: TUCSON ROLLING SHUTTERS, INC., Tucson, AZ (US)

(72) Inventors: Jeffery L. Healam, Tucson, AZ (US); J. Martin Ackerman, Tucson, AZ (US); Don Zimprich, Tucson, AZ (US); Christophe R. Trafton, Tucson, AZ (US)

(73) Assignee: TUCSON ROLLING SHUTTERS, INC., Tucson, AZ (US)

( * ) Notice: Subject to any disclaimer, the term of this patent is extended or adjusted under 35 U.S.C. 154(b) by 574 days.

This patent is subject to a terminal disclaimer.

(21) Appl. No.: 16/425,003

(22) Filed: May 29, 2019

(65) Prior Publication Data

US 2019/0284874 A1 Sep. 19, 2019

Related U.S. Application Data

(63) Continuation-in-part of application No. PCT/US2019/018525, filed on Feb. 19, 2019, and a continuation-in-part of application No. 15/898,880, filed on Feb. 19, 2018, now Pat. No. 10,934,772.

(51) Int. Cl.

| | |
|---|---|
| ***E06B 9/54*** | (2006.01) |
| ***E06B 9/42*** | (2006.01) |
| ***E06B 9/58*** | (2006.01) |
| ***E06B 7/18*** | (2006.01) |
| ***E06B 9/17*** | (2006.01) |

(52) U.S. Cl.

CPC ..... *E06B 9/42* (2013.01); *E06B 7/18* (2013.01); *E06B 9/17046* (2013.01); *E06B 9/54* (2013.01); *E06B 9/58* (2013.01)

(58) Field of Classification Search

CPC .... E06B 9/17046; E06B 9/17076; E06B 9/08; E06B 9/11; E06B 9/17; E06B 9/40; E06B 9/42; E06B 7/18; E06B 7/20; E06B 7/21; E06B 7/215; E06B 7/2316

See application file for complete search history.

(56) References Cited

U.S. PATENT DOCUMENTS

| | | | | | |
|---|---|---|---|---|---|
| 170,029 | A | * | 11/1875 | Sustins | E06B 7/20 49/306 |
| 1,311,127 | A | * | 7/1919 | Kendrick | E06B 7/20 49/307 |
| 1,578,328 | A | * | 3/1926 | Lessing | E06B 7/20 49/307 |
| 1,682,389 | A | * | 8/1928 | Ludeke | E06B 7/20 49/308 |

(Continued)

*Primary Examiner* — Johnnie A. Shablack
(74) *Attorney, Agent, or Firm* — Quarles & Brady LLP

(57) ABSTRACT

A self-adjusting retractable screen system including a sheet of flexible screen material and a bottom bar assembly extending horizontally along a bottom edge of the sheet of flexible screen material from a first end to a second end. The bottom bar assembly includes a termination bar secured to the bottom edge of the sheet of flexible screen material and an adjustable arm received on the termination bar. The adjustable arm can be rotated between a level position and a rotated position.

11 Claims, 17 Drawing Sheets

(56) References Cited

U.S. PATENT DOCUMENTS 1,781,864 A * 11/1930 Wyatt ..... E06B 7/20 49/308
1,785,431 A * 12/1930 Bailey ..... E06B 7/18 49/306
1,913,285 A * 6/1933 Oliver ..... E06B 7/18 49/303
1,963,882 A * 6/1934 Brennan ..... E06B 7/20 49/309
2,066,188 A * 12/1936 Reese ..... E06B 7/20 49/307
2,171,070 A * 8/1939 Raible ..... E06B 7/20 49/308
2,199,860 A * 5/1940 Rogers ..... E06B 7/20 49/308
2,282,019 A * 5/1942 Balousek ..... E06B 7/20 49/307
2,820,261 A * 1/1958 Brown ..... E06B 7/20 49/306
2,870,495 A * 1/1959 Wetzel ..... E06B 7/20 49/309
3,030,674 A * 4/1962 Kapaun ..... E06B 7/20 49/309
3,263,366 A * 8/1966 Woloohojian ..... E06B 7/18 49/314
3,703,788 A * 11/1972 Rivers ..... E06B 7/20 49/307
4,170,846 A * 10/1979 Dumenil ..... E06B 7/20 49/303
4,406,088 A * 9/1983 Berndt, Jr. ..... E06B 7/215 49/309
4,479,330 A * 10/1984 Muller ..... E06B 7/20 49/303
4,519,165 A * 5/1985 Cronenberg ..... E06B 7/215 49/306
4,703,586 A * 11/1987 Smith ..... E06B 7/20 49/303
4,805,345 A * 2/1989 Ohi ..... E06B 7/215 49/308
4,947,584 A * 8/1990 Wexler ..... E06B 7/215 49/307
5,934,353 A * 8/1999 Buhr ..... E06B 9/581 160/269
6,195,939 B1 * 3/2001 Sowers ..... E06B 7/21 49/307
7,320,496 B2 * 1/2008 Griffis ..... B60J 5/0497 296/146.1
7,644,539 B2 * 1/2010 Baxter ..... E06B 7/20 49/470
8,381,448 B2 * 2/2013 Flory ..... E06B 7/215 49/468
8,839,558 B2 * 9/2014 Heidrich ..... B60J 10/86 49/306
8,959,837 B2 * 2/2015 Hans ..... E06B 3/5072 49/316
9,382,752 B1 * 7/2016 Zubay ..... E06B 9/17076
9,428,955 B2 * 8/2016 Fleischman ..... E04F 10/0607
9,453,368 B2 * 9/2016 Burd ..... E06B 7/215
10,533,369 B2 * 1/2020 Dintheer ..... E06B 7/21
10,934,772 B2 * 3/2021 Healam ..... E06B 9/54
2003/0188837 A1 10/2003 Varley et al.
2005/0150607 A1 7/2005 Dekker
2006/0249264 A1 11/2006 Lin
2009/0120593 A1 5/2009 Lesperance
2012/0222828 A1 9/2012 Kwak
2016/0258211 A1 9/2016 Smith et al.
2019/0145158 A1 * 5/2019 Powell ..... E06B 7/215 49/469
2019/0254261 A1 * 8/2019 Volin ..... A01K 31/18
2019/0368266 A1 * 12/2019 Goldfinch ..... E05D 15/0626
2021/0102420 A1 * 4/2021 Goldfinch ..... E06B 7/2303

* cited by examiner

SELF-ADJUSTING BOTTOM BAR FOR A RETRACTABLE SCREEN

CROSS REFERENCE TO RELATED APPLICATIONS

This application is a continuation-in-part of International Application PCT/US2019/018525, having an international filing date of Feb. 19, 2019 and is a continuation-in-part of U.S. patent application Ser. No. 15/898,880 filed on Feb. 19, 2018, the disclosures of both of which are incorporated herein in their entirety.

TECHNICAL FIELD

The present invention relates to a retractable screen and, more particularly, to a retractable screen having a self-adjusting interface to a tilted floor.

BACKGROUND OF THE INVENTION

Retractable screens are increasingly popular architectural elements in both commercial and residential installations. In addition to being used as insect or solar screens for windows, retractable screens enhance the usability of outdoor spaces such as overhung patios, where they provide shade and insect protection for the patio, and allow the interior of an attached home to be opened to the outside.

Conventionally, a retractable screen includes a sheet of flexible screen material attached to a base bar. The screen is stored above a ceiling, in a rolled configuration. The screen can be lowered into a deployed configuration, typically via a command from a wall switch or a remote control. As the screen is lowered, the weight of the base bar exerts a downward force on the sheet of screen material, which keeps the screen flat as it is lowered into position. At the bottom of its travel, the base bar contacts the floor or window sill, at which point, the screen is in its deployed or lowered position.

Conventionally, the drum on which a retractable screen sheet is stored is mounted in a level position and the screen is mounted such that it is lowered in a plum, perpendicular direction, with its square sides perpendicular to level. This is ensures that the screen, which is necessarily flexible, does not kink or wrinkle during the lowering process, or when it is in its final, deployed state. Instead, the weight of the screen itself provides even downward pressure across the screen during the lowering process. Additionally, the base bar is conventionally installed such that it is also level, and therefore, perpendicular to the edges of the screen and the direction of movement of the screen during lowering. When the base bar engages with the floor or sill, the screen is deployed.

In the event that a retractable screen is installed above a floor or window sill that is not level, challenges can arise. For example, if the lowering motion of the screen is stopped when the base bar first contacts the floor or sill (i.e., the floor or sill's high point), there will be a gap beneath the bottom of the base bar and the floor or sill (hereinafter "floor") as the floor slopes downwardly away from the bottom of the base bar. This is unsightly and permits pests to come into the screened space underneath the base bar. This problem is particularly acute when a retractable screen is installed on a patio, since patios typically use a slightly sloped floor to shed water. Complicating matters is the fact that patio retractable screens tend to be very wide, with installations in excess of 10 feet being common. This can result in substantial floor gaps of one inch or more from end-to-end.

One solution to this problem would be to continue to lowering the screen until the entirety of the base bar sits flush with the floor, but on the level of the floor (i.e., at the floor's inclination angle with level). The problem with this approach is that it will take tension out of the screen on the high side of the floor or sill, causing the screen to wrinkle or buckle. An alternative solution is to mount the base bar to the screen such that the base bar is at the angle of the non-level floor, but this would require precise measurements and adjustments during installation, since the angle of the base bar would have to change for every installation. Moreover, this is impractical since the retractable screen is typically fabricated as a single unit at the factory before being transported to the jobs site. The current conventional solution is to use so-called "cat hair"—an apron on the bottom of the base bar composed of fine, flexible bristles or felt, which fills the gap between the bottom of the base bar and the floor when the base bar's translation is stopped at the point of first contact. This solution is undesirable, however, because "cat hair" is unsightly, gathers dust and debris, and for some substantially uneven floors, "cat hair" aprons of up to an inch or more are required. A solution that seals the retractable screen to the floor, in an aesthetically pleasing manner, but without the need for costly and time consuming adjustments at the installation site would be desirable.

SUMMARY OF THE INVENTION

Embodiments of the disclosure are directed to a retractable screen bottom bar assembly having, itself, an adjustable bottom arm. The adjustable bottom arm protrudes from the hollow bar by a predetermined amount, in one embodiment, by 0.75", and is attached to the base bar via a pivot. In certain embodiments, the pivot point is centrally located laterally on the bottom arm, enabling pivoting displacement of 1.5 inches at either end of the adjustable bottom arm. In certain embodiments, the pivot attachment mechanism comprises a pivot having an aperture in the adjustable bottom arm, which cooperates with a pivot bearing in the hollow bar. In certain embodiments, the aperture is oblong (i.e., non-circular), which allows the adjustable bottom arm to translate a predetermined amount, in one embodiment by a distance of 0.25", with respect to the hollow bar when the adjustable bottom arm engages with a floor. By this arrangement, when a bottom arm assembly according to an embodiment of the invention is lowered, the adjustable bottom arm engages with a "high side" of the floor, and then pivots with respect to the bottom bar, with one side of the adjustable bottom arm being pushed up into a receiving slot in the hollow bar, and the opposite side pivoting down toward the floor. The pivot continues until the bottom arm's bottom surface attains flush engagement with the floor. This provides a sealed engagement between a level bottom bar assembly and a non-level floor, in a visually pleasing, neat manner, without the need for substantial on-site adjustment, or even prior knowledge of the extent or angle to which the floor is off-level.

While the embodiments of the disclosure described below refer to a single adjustable bottom arm pivotably engaged with a hollow bar via a single, centrally located pivot point, this is not a limitation. In alternative embodiments, multiple adjustable bottom arms are provided across the bottom of a single hollow bar, each being attached at a separate pivot point, with the pivot points horizontally spaced across the hollow bar. In some embodiments, 2 adjustable bottom arms are provided. In other embodiments, 3 adjustable bottom arms are provided. In yet other embodiments, 4 adjustable bottom arms are provided. This arrangement allows for a bottom arm to seal to an uneven floor, even where the floor is not monotonic, i.e., has a changing slope, both in terms of its degree and in terms of its sign. In other embodiments, two bottom arms are provided, each of which pivotably engages the bar at the same pivot point, forming a pair of adjustable "wings" usable to match a floor with a "hump".

In other embodiments, a bottom bar assembly includes a mechanism for holding the adjustable arm level while the screen is being raised or lowered. In certain embodiments, this is accomplished by cooperative magnetic assemblies including magnets arranged at the ends of the hollow bar, and at the ends of the adjustable bottom arm. Each of these magnet assemblies magnetically cooperates to cause the adjustable bottom arm to resist pivoting as the assembly is raised or lowered, until the adjustable bottom arm engages with the floor, at which point, the pivoting force caused by the engagement is sufficient to overcome the magnetic force, allowing the arm to pivot. In certain embodiments, the adjustable bottom bar assembly includes a mechanism for pushing the adjustable bottom arm to level when it is not engaged with the floor, so that magnets mounted in the adjustable bottom arm can be magnetically engaged by magnets mounted in the hollow bar.

Thus, in these embodiments, when the bottom bar assembly and a screen attached to the assembly are retracted, when the adjustable bottom arm is no longer engaged with the floor, an internal leveling mechanism exerts a leveling force on the adjustable bottom arm pushing it toward level, at which point the magnetic assemblies engage to hold the hollow bar level for the duration of the retraction. In some embodiments, this leveling mechanism exerts a pushing force on the adjustable bottom arm. In other embodiments, the leveling mechanism exerts a pulling force. In certain embodiments, the leveling mechanism is a cone shaped spring.

Certain embodiments are directed to a method for deploying a retractable screen. The method includes the steps of providing a sheet of flexible screen material, and providing a bottom bar assembly. The bottom bar assembly has a bottom bar with a top side, a bottom side, and a front and back face, and the bottom bar is attached to a bottom edge of the sheet of flexible screen material. The bottom bar assembly also defines a downwardly facing channel having an open end at the bottom bar's bottom side. The method also includes providing an adjustable arm arranged with a top portion within the downwardly facing channel of the bottom bar assembly and a bottom portion extending downwardly past the bottom side of the bottom bar assembly. The adjustable arm is pivotably attached to a pivot point on the bottom bar and may rotate with respect to the bottom bar about the pivot point. The method also includes translating the retractable screen in a downward direction toward a planar surface until a lower edge of the adjustable bar contacts a portion of the planar surface, causing the adjustable arm to pivot with respect to the bottom bar assembly.

In some embodiments, a self-adjusting retractable screen system can include a sheet of flexible screen material and an adjustable bottom bar assembly extending horizontally along a bottom edge of the sheet of flexible screen material from a first end to a second end. The adjustable bottom bar assembly can include a bottom bar secured to the bottom edge of the sheet of flexible screen material and an adjustable arm. The bottom bar can include a pivot point positioned between the first end and the second end and the adjustable arm rotatably can be secured the pivot point of the bottom bar so that a portion of a bottom edge of the adjustable arm extends below a bottom edge of the bottom bar. The adjustable bottom bar assembly can also include at least one biasing element extending between the adjustable arm and the bottom bar. The at least one biasing element can be configured to selectively bias the adjustable arm so that the bottom edge of the adjustable arm is parallel to the bottom edge of the bottom bar.

In some aspects, the at least one biasing element can be an extension spring, which may be configured to pull an end of the adjustable arm towards the bottom bar.

In some aspects, the at least one biasing element can include a first biasing element and a second biasing element positioned on opposite sides of the pivot point. Only one of the first biasing element and the second biasing element may be configured apply a biasing force to the adjustable arm.

In some aspects, the first biasing element can be positioned proximate the first end and the second biasing element positioned can be proximate the second end. The first biasing element may be configured to bias a first end of the adjustable arm towards a first end of the bottom bar, and the second biasing element may be configured to bias a second end of the adjustable arm towards a second end of the bottom bar.

In some aspects, the adjustable bottom bar assembly can include a spring block received by the bottom bar. The spring block may be configured to receive an upper end of the biasing element. The spring block can also include a pin extending horizontally across the spring block, and the biasing element upper end of the biasing element can include a loop section configured to extend around the horizontal shaft thereby securing the biasing element to the bottom bar. Further, the spring block can be received by at least one rail extending horizontally across the bottom bar.

In some aspects, the adjustable bottom bar assembly can include a spring plate coupled to a top side of the adjustable arm. The spring plate can be configured to receive a lower end of the biasing element. The spring plate can also include a plate opening configured to receive the lower end of the biasing element to secure the biasing element to the adjustable arm.

In some aspects, the pivot point can include a cylindrical bearing attached to the bottom bar, and the adjustable arm can include a pivot aperture block coupled to a top side of the adjustable arm. The pivot aperture block can include an aperture configured to receive the cylindrical bearing such that the adjustable arm can rotate about the cylindrical bearing. Further, the pivot aperture block may be received in an upward facing channel on the adjustable arm, and the aperture can be positioned above the top side of the adjustable arm.

In some aspects, the bottom bar can define a downwardly facing channel having an open end at a bottom side of the bottom bar, and the adjustable arm can have a top portion received within the downwardly facing channel of the bottom bar.

In some aspects, the bottom bar and the adjustable arm may each include magnets configured to magnetically engage one another when the bottom edge of the adjustable arm is level with the bottom side of the bottom bar.

In some embodiments, a self-adjusting retractable screen system can include a sheet of flexible screen material and an adjustable bottom bar assembly extending horizontally along a bottom edge of the sheet of flexible screen material from a first end to a second end. The adjustable bottom bar assembly can include a bottom bar secured to the bottom edge of the sheet of flexible screen material and an adjustable arm received by the bottom bar. The adjustable arm may be rotatable between a level position where a bottom edge of the adjustable arm is parallel to the bottom bar and a rotated position where the bottom edge of the adjustable arm is at an oblique angle relative to the bottom bar.

In some aspects, the adjustable arm can have an interior cavity and a vertical slot extending through a top wall of the adjustable arm between the first end and the second end of the adjustable bottom bar assembly. Further, the bottom bar may be configured to be received in the interior cavity with the sheet of flexible screen material extending through the vertical slot.

In some aspects, the adjustable arm can be slidably received on the bottom bar. The adjustable bottom bar assembly can include an end plug that may be secured to the bottom bar at the first end and the second end, and the end plugs may be configured to retain the adjustable arm on the bottom bar.

In some aspects, a height of the interior cavity can be larger than a height of the bottom bar so that the adjustable arm can move vertically with respect to the bottom bar.

In some aspects, the top wall of the adjustable arm can rest on a top side of the bottom bar when the adjustable arm is in the level position.

In some aspects, one end of the adjustable arm may be configured to move a different vertical distance from the bottom bar than an opposite end of the adjustable arm, thereby rotating the adjustable arm relative to the bottom bar.

Embodiments of the invention have certain advantages. By using an adjustable bottom arm, a retractable screen can be installed on site, with minimal adjustment, over an uneven floor, and obtain a clean-looking mechanical seal with the uneven floor. Additionally, such a seal can be obtained without the use of unsightly measures such as a "cat-hair" apron. Additionally, embodiments of the invention preserve the neat appearance of the screen as it is raised and lowered by providing a mechanism for self-leveling of the adjustable bottom arm when it is not engaged by contact with the floor. Additional advantages will become clear upon consideration of the following detailed description.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION OF SPECIFIC EMBODIMENTS

Figure 1A:
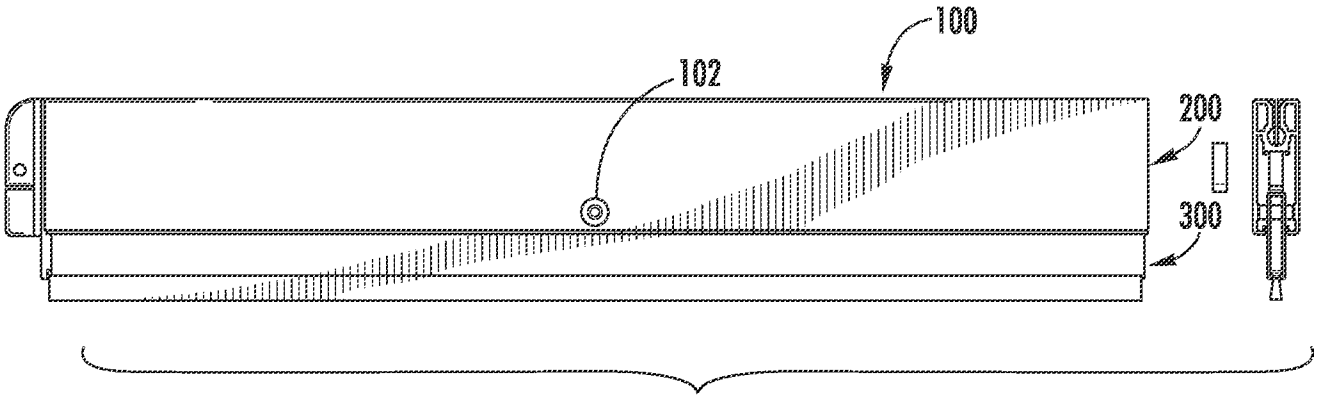
FIG. 1A illustrates an embodiment of a bottom bar assembly for a retractable screen.

The current disclosure describes an apparatus that can be installed on a bottom of a screen to self-adjust when touches a sloped surface. References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention.

In addition, the following disclosure may describe features of the invention with reference to corresponding drawings, in which like numbers represent the same or similar elements wherever possible. In the drawings, the depicted structural elements are generally not to scale, and certain components are enlarged relative to the other components for purposes of emphasis and understanding. It is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed.

Figure 6:
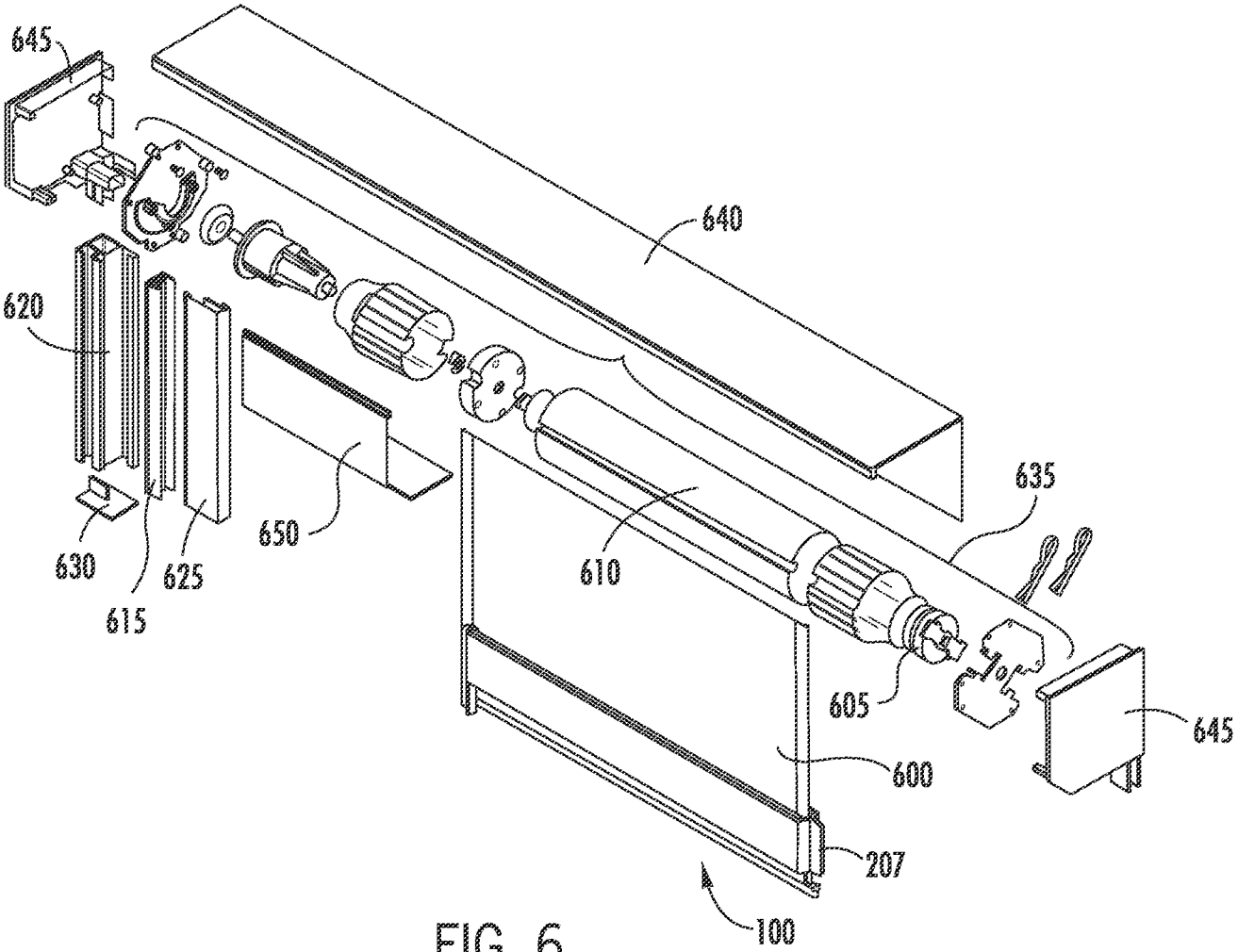
FIG. 6 show an exploded view of a self-adjusting retractable screen assembly including ceiling mounting components.

FIG. 6 shows a retractable screen assembly usable in accordance with certain inventive embodiments. The assembly includes a flexible fabric screen 600 which is deployable from screen storage and drive assembly 635, including a storage drum 610 and motor 605. Flexible fabric screen is wound around drum 610 when the screen is retracted. Flexible fabric screen is lowered or raised as drum 610 is rotated by motor 605. Screen storage and drive assembly 635 is typically installed on or above a ceiling or on an interior or exterior wall fascia above an opening to be screened, e.g., a window or patio opening. In installations where screen storage and drive assembly 635 would otherwise be visible, it is concealed with various covers, e.g., back housing 640, end caps 645 and hood 650, which surround and enclose drive assembly 635, leaving a bottom facing opening or slot through which to lower the screen.

Screen 600 is attached at its lower end to an adjustable bottom bar assembly 100, which is described in additional detail below. Adjustable bottom bar assembly 100 includes end plugs (e.g., 207), each of which has a raised fin which engages and rides in a rail gasket 615. Rail gasket is captured within rail base 620. Rail base 620, rail gasket 615, rail cover 625 and rail plug 630 together comprise a rail assembly that is affixed to a wall defining a window or patio opening. A mutually facing pair of such rail assemblies is used in each retractable screen installation. During the screen lowering process, the engagement between the fins of the bar assembly end plugs and the rail gasket ensures that the screen is lowered in a plum, vertical direction without any deflection or movement due to wind or the like.

Figure 1B:
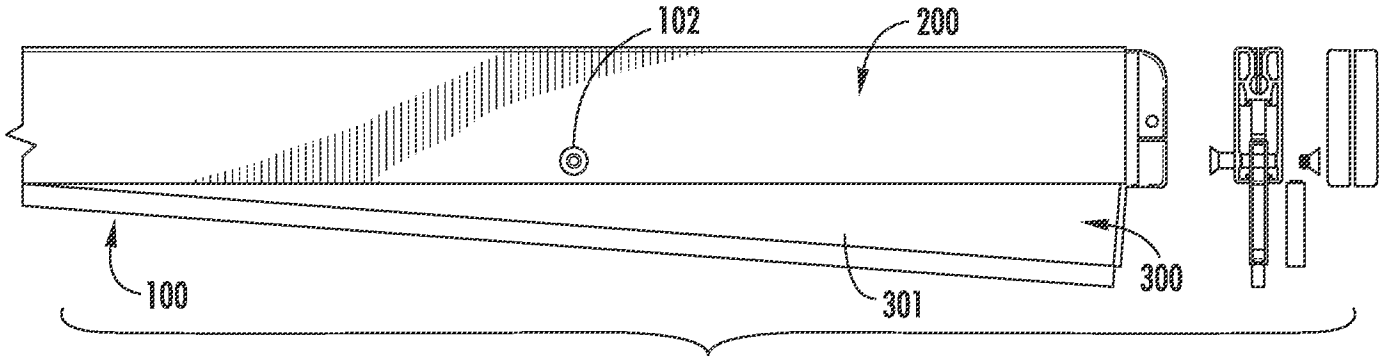
FIG. 1B shows the bottom bar assembly of FIG. 1A when engaged with an uneven floor.

Now referring to FIGS. 1A and 1B, adjustable bottom bar assembly 100 for a retractable screen assembly is shown. The adjustable bottom bar assembly 100 includes a bottom bar assembly 200 and adjustable arm assembly 300. The bottom bar assembly 200 is pivotably connected to adjustable arm assembly 300 at pivot point 102 via a pivot block assembly 400 (FIG. 3) such that an adjustable arm 301 protrudes from a bottom surface of the bottom bar assembly 200 and may pivot about pivot point 102. Thus, as is shown in FIG. 1B, as the adjustable bottom bar assembly 100 is translated in a downward direction, when the adjustable arm 301 of adjustable arm assembly 300 contacts a high point of an uneven plane such as a floor, the entire adjustable arm 301 tilts until it engages the plane of the floor, with a portion of the adjustable arm 301 pivoting up into a receiving channel in the bottom of a bottom bar 201 (FIG. 2), while the other portion the adjustable arm pivots down.

Figure 4:
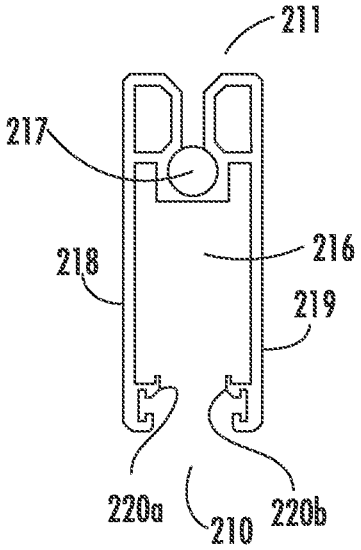
FIG. 4 is a cross sectional view of a hollow bar.

Referring now to FIGS. 1, 4 and 7A-C, an adjustable bottom bar assembly 100 includes subassemblies, bottom bar assembly 200 and adjustable arm assembly 300 described above with respect to FIG. 1. Bottom bar assembly 200 comprises a bottom bar 201, which houses a center pivot block 202, a first magnetic end plug 206, and a second magnetic end plug 207, which are arranged at either end of bottom bar 201, and which slot into a central channel 216 defined by bottom bar 201. Further, the bottom bar 201 has an upper end 211 (FIG. 4), an opposing lower end 210 (FIG. 4), and defines a downwardly facing U-shaped central channel 216 (FIGS. 1 and 4). At the upper end 211, the bottom bar 201 defines an upwardly facing channel 217 having a keyhole shaped cross section (FIG. 4). This channel 217 receives the flexible fabric screen 600 (FIG. 6), thereby attaching it to bottom bar 201. The bottom bar 201 further defines an aperture 213 (FIGS. 7A and B) in a front face of the bottom bar 201, penetrating a front wall 218 of the bottom bar 201. Bottom bar 201 also includes a set of rails 220*a*, 220*b* (FIG. 4) located on side walls 218, 219 and in a lower portion of downward facing channel 216.

Figure 2:
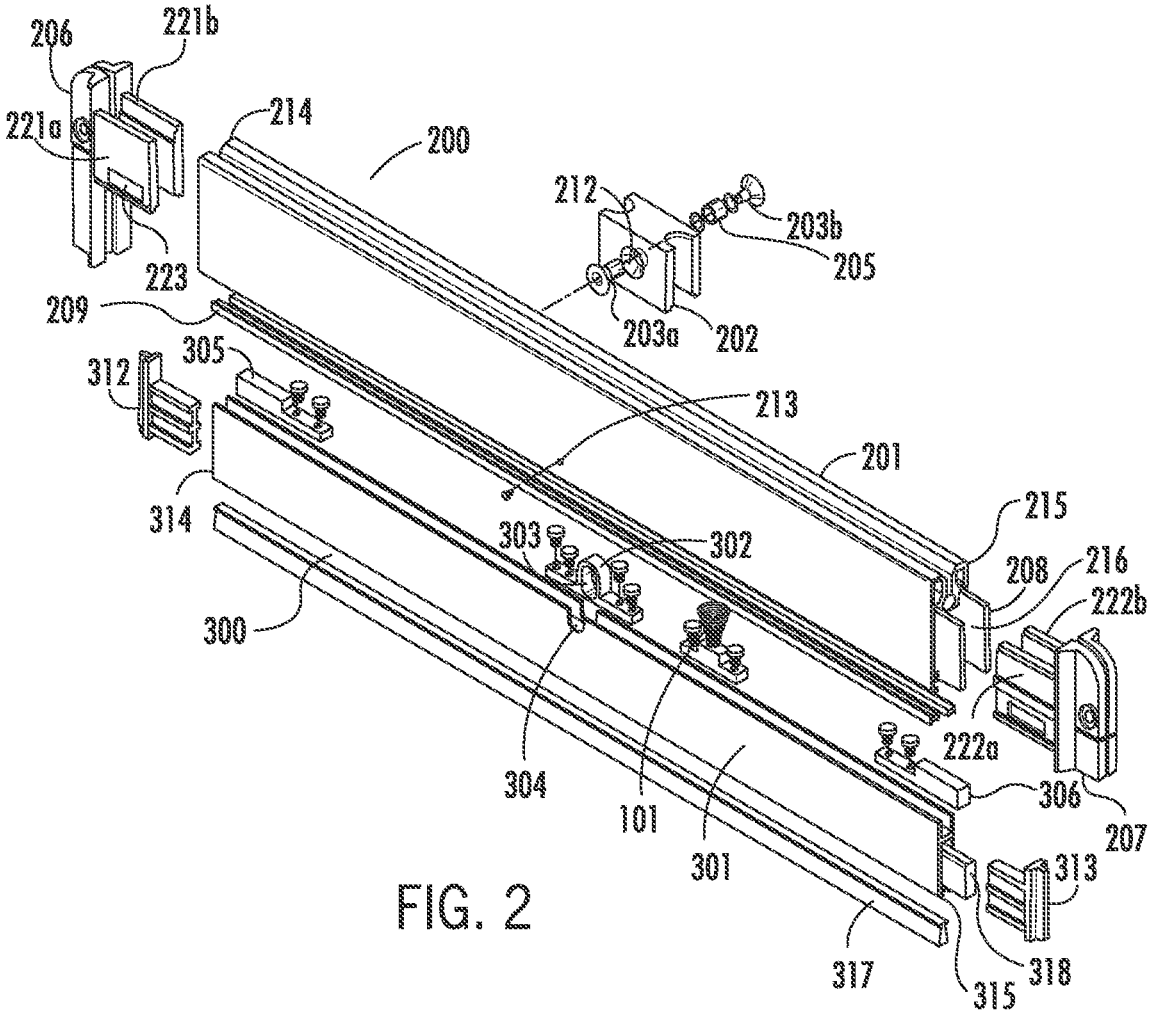
FIG. 2 is an exploded view of the apparatus illustrated in FIG. 1.
Figure 5:
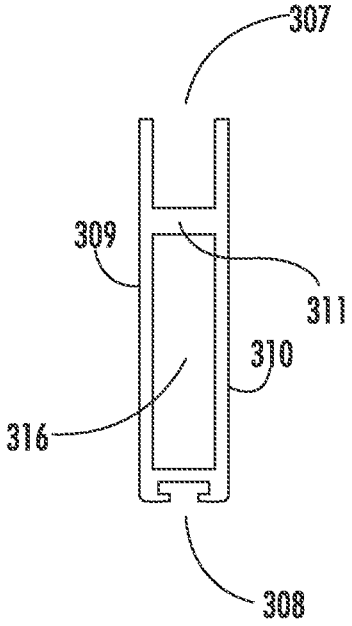
FIG. 5 is a cross sectional view of an adjustable arm.
Figure 7A:
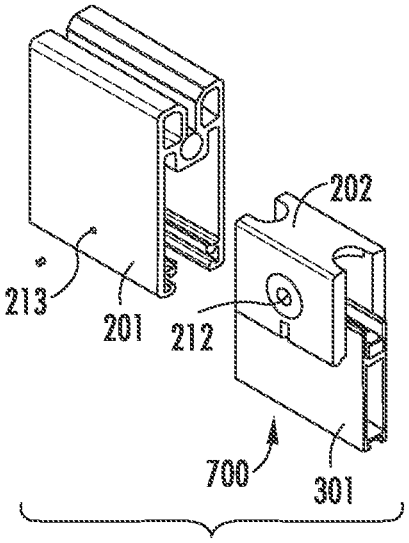
FIG. 7A illustrates a portion of a hollow bar with a center pivot block attached to an adjustable arm.

The operation of the pivot point 102 between bottom bar assembly 200 and adjustable arm assembly 300 will now be described in in reference to FIGS. 1, 2-5 and 7A-7C. Referring now to FIG. 5, there is shown a cross section of an adjustable arm 301. Adjustable arm 301 defines a square u-shaped upwardly facing channel 307 having a medial divide 311. This upwardly facing channel 307 receives pivot aperture block 302, which rests on medial divide 311 and is attached thereto with fasteners as shown in FIG. 2. Pivot aperture block 302 defines an aperture 303, which is some embodiments is oblong, having a longer vertical dimension than its horizontal dimension. During assembly of the adjustable bottom bar assembly 100, pivot aperture block is pivotably pinned to pivot block 202 (FIGS. 2 and 7*a*). Pivot block 202 defines through-bore 212 (FIG. 2), which penetrates both the front and back walls of pivot block 202. Pivot block 202 is hollow and open to the bottom, and during assembly is slid down and over pivot aperture block 302 until it's through bore 212 is aligned with the aperture 303 of pivot aperture block 302. Pivot block 202 is then pivotably pinned to pivot aperture block 302 by the insertion of sleeve bearing 205 into bore 212.

The diameter of sleeve bearing 205 is chosen to be slightly less than the inside diameter of bore 212, such that it is captured within bore 212, but is free to rotate within bore 212. Because of previous alignment of aperture 303 with bore 212, after insertion of sleeve bearing 205, sleeve bearing rests in aperture 303 and thereby rotatably engages pivot aperture block 302. In certain embodiments, sleeve bearing 205 is sufficiently long to engage the bore holes in the front and back walls of pivot block 202, but this is not a requirement. Sleeve bearing 205 is secured to pivot block 202 with pan-head screws 203*a*, 203*b*, which engage sleeve bearing 205 (which has an interior threaded bore) from either side as shown. The result is a pivot block assembly 400, in which pivot block 202 is pinned to pivot aperture block 302, and can rotate with respect to pivot aperture block 302 as the bearing sleeve 205 rotates with respect to bearing aperture block 302.

Figure 3:
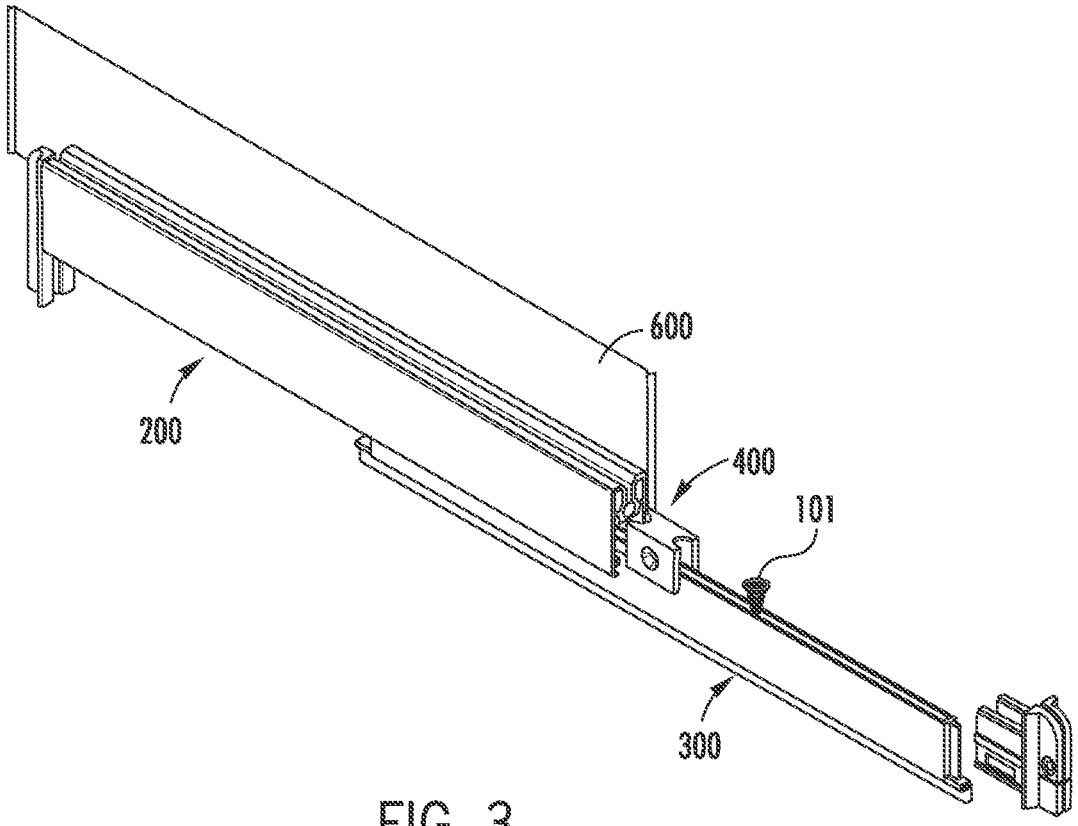
FIG. 3 illustrates a manner of assembly for the adjustable arm and bottom bar of FIGS. 1A, 1B, and 2.
Figure 7B:
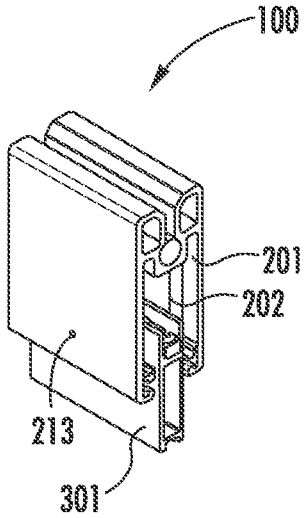
FIG. 7B shows an assembly of a hollow bar, a center pivot block, and an adjustable arm.
Figure 7C:
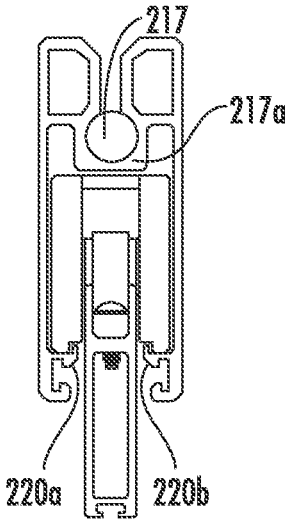
FIG. 7C is a cross sectional view of the adjustable bottom bar assembly illustrated in FIG. 7B.

To complete the assembly of adjustable bottom bar assembly 100, pivot block assembly 400, including pivot block 202, which at this point is attached to pivot aperture block 302 and thereby to adjustable arm assembly 300, is slid into channel 216 of bottom bar 201 through one of bottom bar 201's open ends 214 or 215. This process is illustrated in FIGS. 3 and 7A-B. Pivot block 202 is then slid down channel 216, where it engages with rails 220*a*, 220*b* (FIG. 4) until it is centered in bottom bar 201. At that point, it is secured to bottom bar 201 by inserting a set screws through aperture 212 (FIG. 2), which engages with pivot block 202. The result of this process is the pivotable attachment of bottom bar assembly 200 to adjustable arm assembly 300 at a central pivot point 102 (FIG. 1).

Figure 9A:
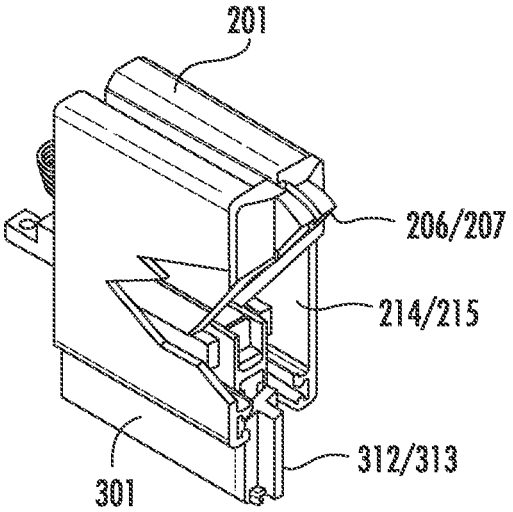
FIG. 9A shows an end of assembled adjustable arm and bottom bar with a magnetic plug and a magnet.

Referring now again to FIG. 2, bottom bar assembly 200 includes magnetic plugs 206, 207 each include a pair of inwardly projecting arms 221*a*, 221*b*, and 222*a*, 222*b* respectively (FIG. 2), and each arm includes a magnet 223, for a total of four magnets associated with the magnet plugs. Referring to FIG. 9A, during assembly, magnetic plug 206 is inserted into the bottom bar 201 from first end 214 of the bottom bar 201 and the second magnetic plug 207 is inserted into the bottom bar 201 from the second end 215. After assembly, now referring to FIG. 9B, the inwardly projecting arms 221*a*, 221*b* and 222*a*, 222*b* of magnetic plugs 206, 207 lie alongside interior surfaces of channel 216 such that magnets 223 for each pair of arms define a gap between themselves, the center of which is centered in channel 216.

Referring still to FIG. 2, bottom bar assembly 200 also includes a pair of felt strips 209 at bottom bar 201's lower end 210. Felt strips 209 project inwardly into channel 216, and together, serve to center adjustable arm 301 in channel 216. Additionally, the felt strips keep water, dirt, and other debris out of the adjustable bottom bar assembly 100.

In certain embodiments, the bottom bar assembly 200 further comprises metal inserts 208*a*, 208*b*, 208*c*, 208*d* to add weight. For example, in some embodiments, to one side of channel 217 next to side wall 218 (FIG. 4), two metal inserts 208*a*, 208*b* are inserted into channel 216. Similarly, to the other side of channel 217 next the side wall 219, two metal inserts 208*c*, 208*d* are inserted into channel 216. Each metal insert also fits between center pivot block 202 and a magnetic plug. The metal inserts 208*a*, 208*b*, 208*c*, 208*d* facilitate the deployment of the sheet of screen material downwardly and when the screen is deployed, the weight of metal inserts 208*a*, 208*b* help the sheet of screen material to stay wrinkle free. Each metal insert 208 is about 1.5 inches tall and about 0.125 inches thick. While specific values chosen for this embodiment are recited, it is to be understood that, within the scope of the invention, the values of all of parameters may vary over wide ranges to suit different applications. As used herein, "about" is used to account for ±10% differences in any measurement.

The adjustable bottom bar assembly of FIG. 2 also includes an adjustable arm assembly 300, which includes adjustable arm 301, a pivot aperture block 302, a first magnet 305, and a second magnet 306. Adjustable arm 301 defines a hollow central channel 316 (FIG. 5), an upwardly facing U-shaped channel 307 (FIG. 5), and a downwardly facing U-shaped channel 308 (FIG. 5). Upwardly facing channel 307 is defined, in part, by medial divide 311 (FIG. 5). As is discussed above, pivot aperture block 302 further defines an aperture, 303, which in certain embodiments is elliptical or oval shaped, with a long axis oriented vertically. In other embodiments, aperture 303 is O-shaped. In embodiments where aperture 303 is oblong, adjustable arm 301 is free to translate vertical by the extent of the vertical difference between aperture 303 and the outside diameter of sleeve bearing 205. Adjustable arm 301 also defines a bore 304 through adjustable arm, penetrating each of side walls 309, 310 of adjustable arm 301. Pivot aperture block 302 is disposed on and fastened to the center of the medial divide 311, in upwardly facing channel 307, such that its aperture 303 is aligned with bore 304. Additionally, magnet 305 is also disposed towards a first end 314 of the adjustable arm 301 and fastened to the medial divide 311 in channel 307. The magnet 306 is also disposed towards a second end 315 of the adjustable arm 301 and fastened to the medial divide 311 in channel 307. Different ways of removably fastening the center pivot block 302 and magnets 305 and 306 to the medial divide 311 can be used, such as using screws.

In addition, the adjustable arm assembly 300 contains a first arm plug 312, a second arm plug 313, a metal insert 318, and a strip of downwardly facing felt. In some embodiments, this felt is about 0.4 inch in height. In other embodiments, the felt is about 1 inch in height. The examples here are not meant to be limiting and the felt may vary in height to suit different applications. The first arm plug 312 is disposed towards the end 314 and inserted into the channel 316. Similarly, the second arm plug 313 is disposed towards the end 315 and inserted into the channel 316. Just like metal inserts are used in bottom bar assembly 200 to weigh it down, the metal insert 318 is inserted in the channel 316 to weigh down adjustable arm assembly 300 to facilitate deploying the sheet of screen material downwardly and to help deployed screen material stay wrinkle free. In certain embodiments, the metal insert 318 is about 0.25 inches tall and about 0.75 inches thick.

It will be seen that in the assembled system of FIG. 2, and also referring to FIGS. 9A and B, magnets 305, 306 are aligned with and between respective pairs of magnets 223 when adjustable arm assembly 300 is level with respect to the bottom bar assembly 200. The polarities of these magnets are chosen such that each magnet pair on bottom bar 201 magnetically engages with one of magnets 305, 306 on adjustable arm 301, such that when there is not vertical force applied to thereon, adjustable arm 301 is held in place and is level. Thus, as adjustable bottom bar assembly 100 is lowered, adjustable arm 301 remains stable and level with respect to bottom bar 201, and does not swing or pivot in an unsightly manner, despite the vibration and instability introduced by lowering the adjustable bottom bar assembly 100 to the ground. The magnetic engagement, however, does not have sufficient force to resist adjustable arm 301 pivoting when it contacts the off-level floor. Thus, when adjustable arm 301, or specifically, felt, contacts a high point on a floor during its downward movement, it pivots about the pivot point (102 in FIGS. 1A and 1B), until the entire adjustable arm 301 is engaging the floor in a flush manner. Therefore, in a case when adjustable bottom bar assembly 100 is level, but floor is off-level, when the screen is deployed, bottom bar 201 will remain level (and the attached screen will not wrinkle or kink), while adjustable arm 301 will be inclined at the angle of the floor, providing a flush seal to the floor.

Figure 9B:
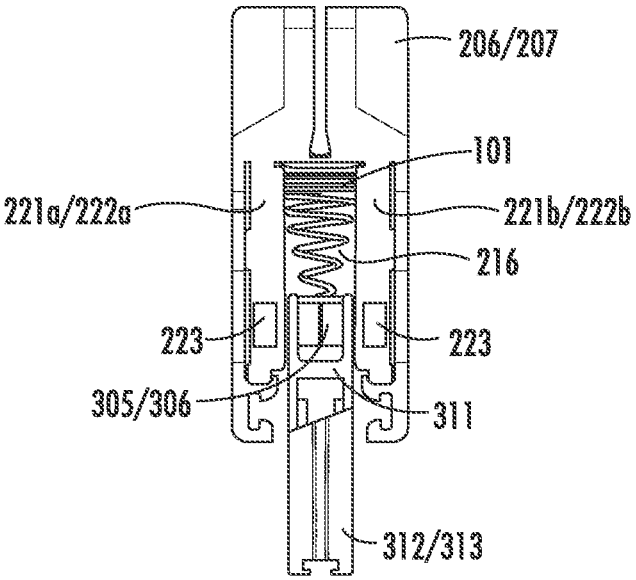
FIG. 9B is a cross sectional view of FIG. 9A.

When adjustable bottom bar assembly 100 is retracted off the floor, adjustable arm 301 will have a natural tendency to remain in its inclined position. The engagement between magnets 305, 306, 223 may be sufficiently strong to pull adjustable arm 301 level, but this is not a requirement for all embodiments. Certain embodiments include a mechanism for pushing adjustable arm 301 level so that the magnets 305, 306 get close enough to magnets 223 for magnetic engagement to occur. Referring now to FIGS. 2, 3 and 9B, a spring 101 is arranged between adjustable arm 301 and bottom bar 201, and is located laterally with respect to pivot block assembly 400. In one embodiment, spring 101 is arranged in upwardly facing channel 307 of adjustable arm 301, but in alternative embodiments, spring 101 is attached to bottom bar 201 rather than to adjustable arm 301. In certain embodiments, spring 101 is affixed to adjustable bottom bar assembly 100 on the side of the assembly where adjustable arm 301 pivots up into bottom bar 201 (i.e., on the side of the pivot block assembly 102 where the floor is high). In alternative embodiments, a pair of springs are used, one on each side of pivot block assembly 400.

When adjustable arm 301 pivots because of engagement with the floor, spring 101 will compress. When adjustable bottom bar assembly 100 is retracted, the compressed spring 101 pushes down on the medial divide 311 (and up on the top surface of channel 216 in bottom bar 201), and exerts downward force on one side adjustable arm 301, which returns it to an approximately level position, at which point it is there captured magnetically by magnets 305, 306, 223. Spring 101 is sized to exert no force between bottom bar 201 and adjustable arm 301 when adjustable arm 301 is level with respect to bottom bar 201. In certain embodiments, conical springs are used, but other methods are possible and within the scope of the invention. For example, the springs could be leaf springs. A single spring (e.g., a leaf spring) capable exerting no force in a neutral, level position, but capable of both pushing and pulling, depending on the tilt of adjustable arm 301 would also be acceptable.

Figure 8:
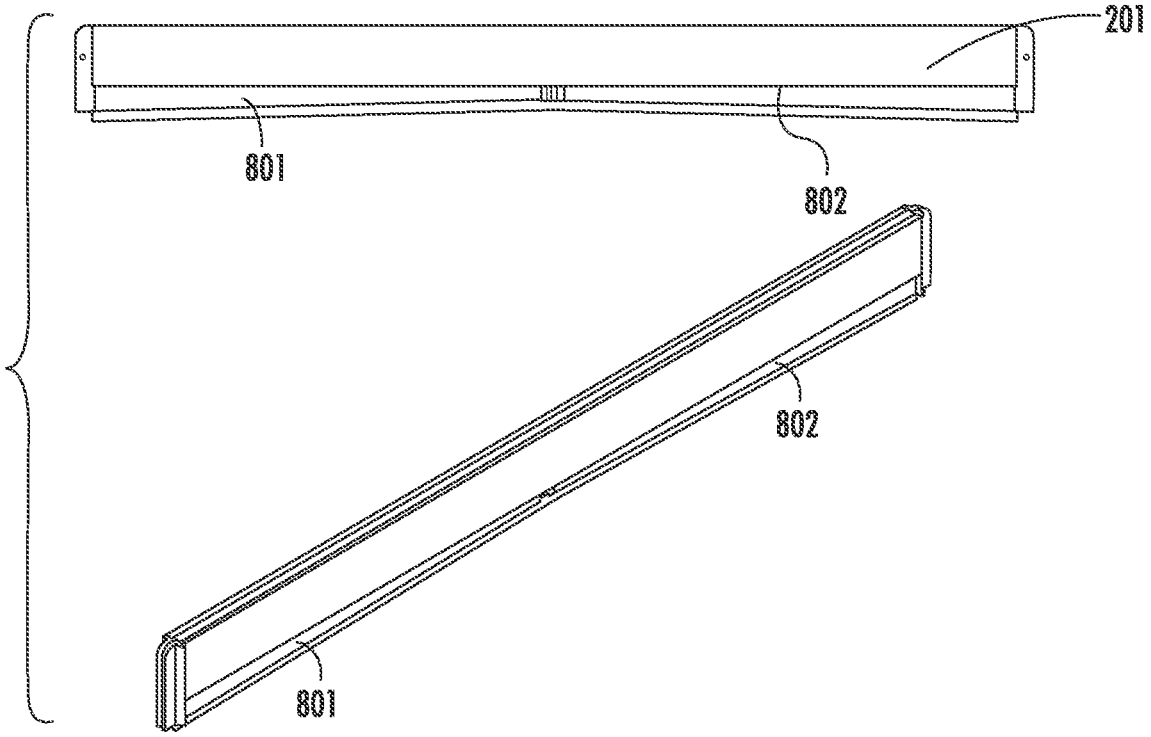
FIG. 8 illustrates a different embodiment of the bottom bar assembly.

Referring to FIG. 8, in certain embodiments, there are multiple adjustable arms 801 and 802, each capable of pivoting, which span the lateral extent of the assembly. In the embodiment of FIG. 8, two adjustable arms 801 and 802 are provided, each of which is attached to a centrally located pivot point, and each of which can pivot from that central point as shown. This embodiment of the adjustable bottom bar assembly 100 allows a flush seal to a floor that has a center high point and slopes downwardly both sides from the center high point. In other embodiments, 3 or more adjustable bottom arms are utilized to allow for a flush engagement between the adjustable bottom bar assembly 100 and a floor that has multiple non-monotonic height variations. In these embodiments, multiple adjustable arms, each pivotably attached to its own pivot, are laterally spaced across the bottom of a bottom arm, forming a segmented linear array of adjustable arms.

Figure 10:
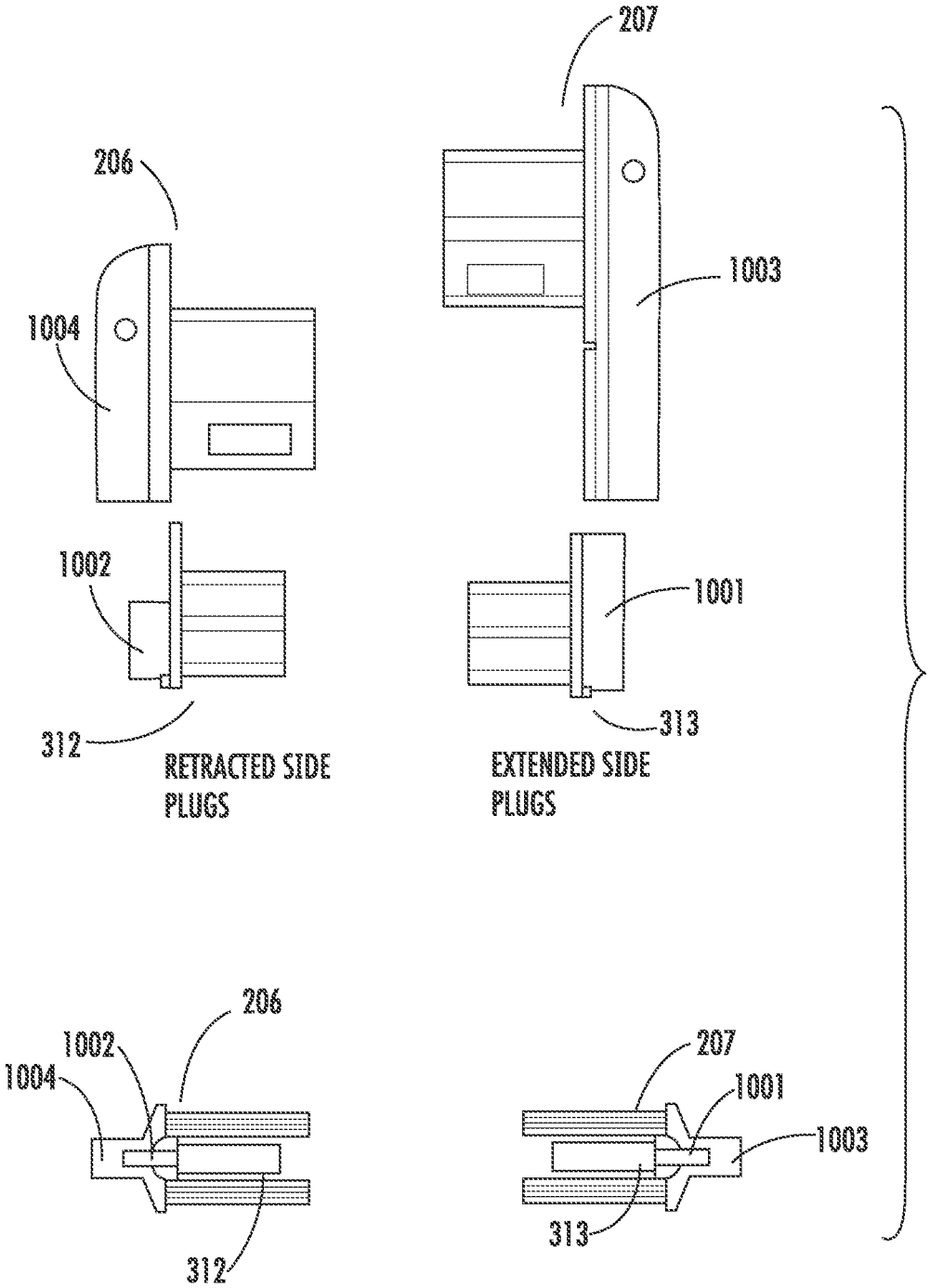
FIG. 10 shows right-and-left specific bar and arm end plugs for certain screen installations.

Referring now to FIG. 10, a particular embodiment's bar and arm end plugs will be described in additional detail. Adjustable arm end plugs 312, 313 have outwardly extending vertical fins 1002, 1001. Likewise, bar end plugs 206, 207 have outwardly extending vertical fins 1004, 1003. Arm fins 1001, 1002 fit into corresponding slots defined in bar end plugs 207, 206 as shown. It will be recognized that clearance issues may arise between the arm end plug fins and arm end plugs as the arm pivots up into the bar on the retracted side, i.e., the side corresponding to the high side of the floor. To account for this, the vertical extent of the arm end plug fin 1002 may be shortened on the retracted side of the assembly. Additionally, on the extended side, where the arm plug fin 1001 pivots down and away from the bar, a gap might be revealed between fin 1001 and plug 207. To account for this, an arm end plug with a longer fin 1001 and a bar end plug with a longer fin 1003 may be provided. During installation, plugs having long fins may be provided, which are then cut down to the appropriate size depending on the extent to which the adjustable arm pivots for a given installation. Alternatively, measurements may be taken on-sight, and appropriate left and right end plugs may be constructed off site for later installation.

Figure 11:
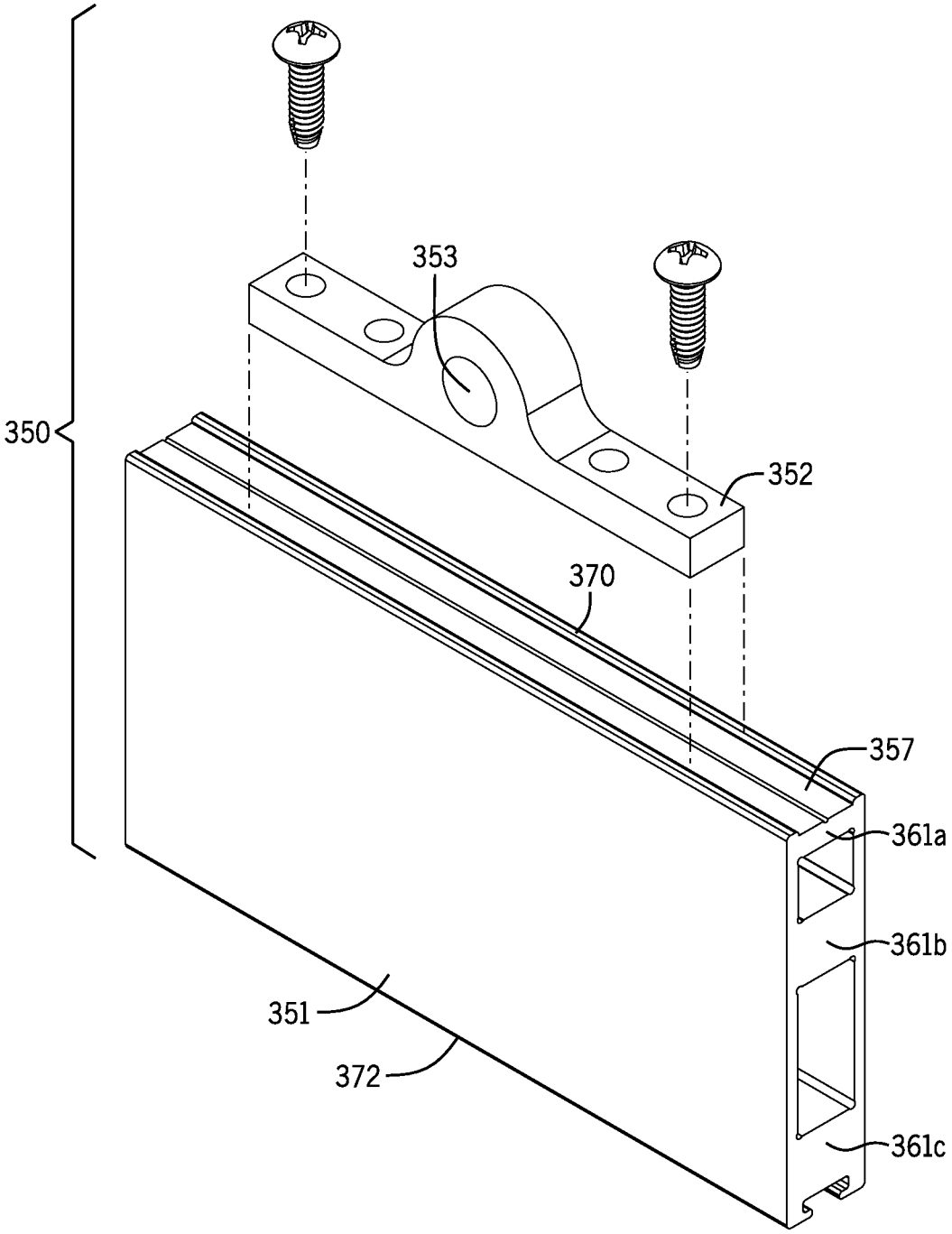
FIG. 11 is an exploded perspective view of a portion of an adjustable arm with a pivot aperture block.
Figure 12B:
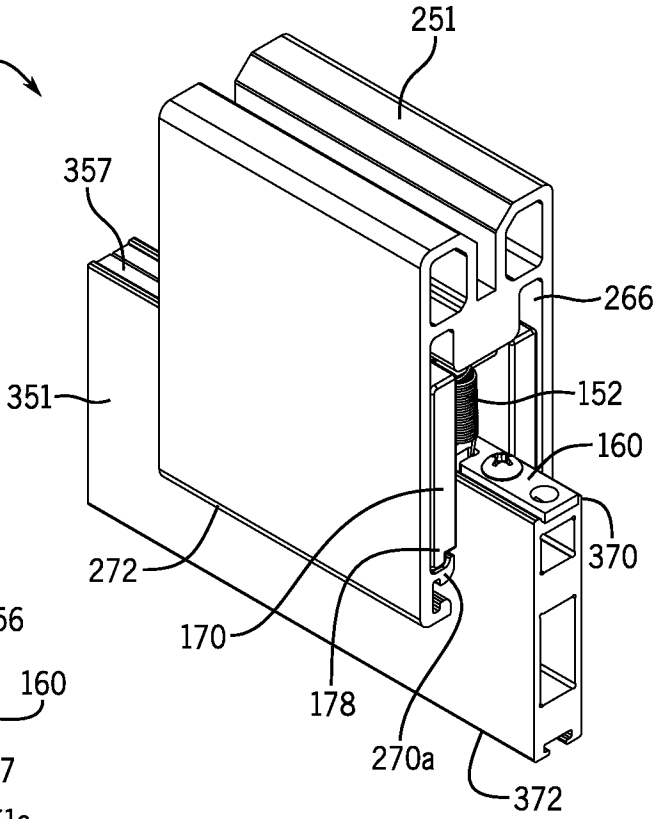
FIG. 12B is a perspective view of a portion of the assembled bottom bar assembly of FIG. 12A.
Figure 12A:
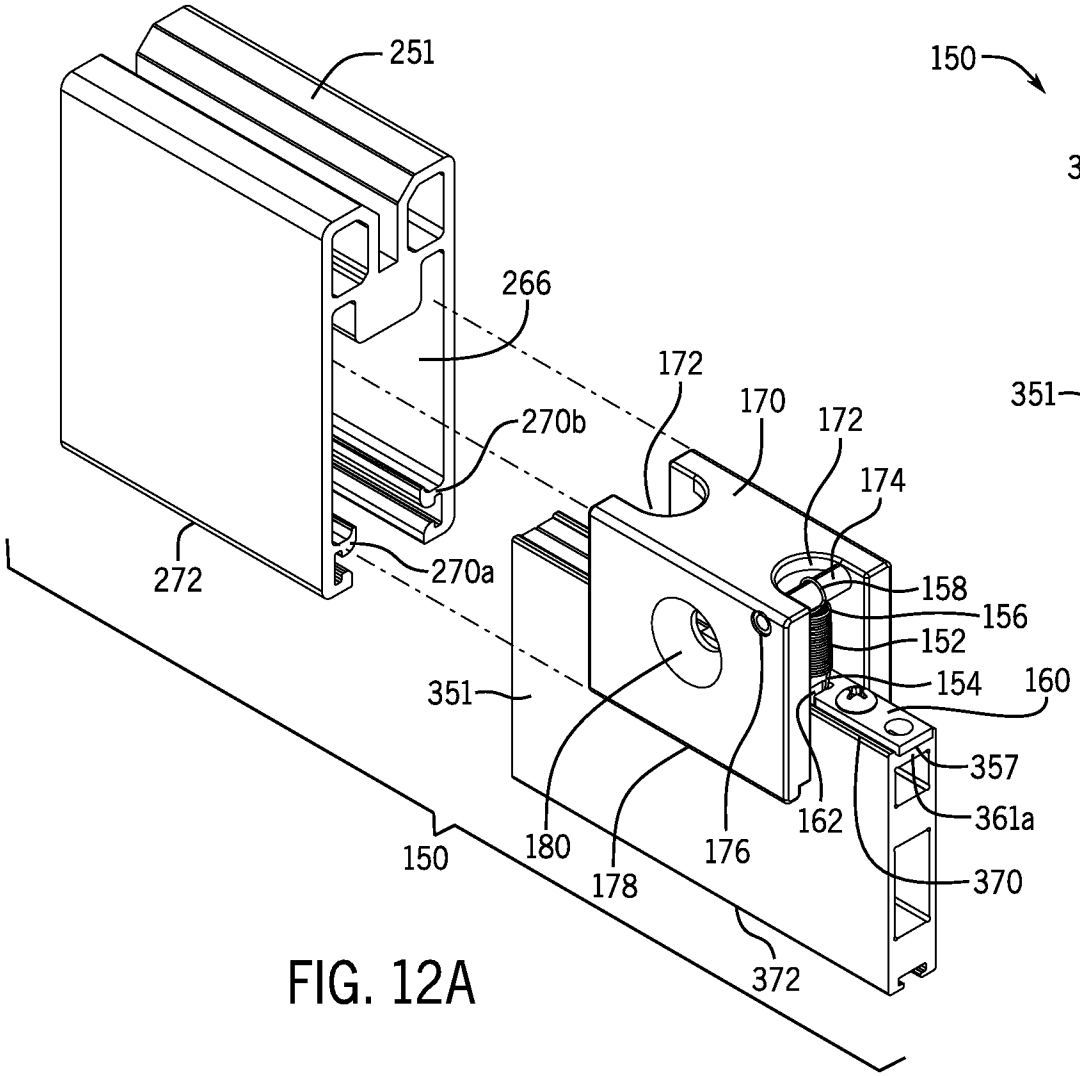
FIG. 12A is a perspective view a portion of an adjustable bottom bar assembly including a bottom bar and an adjustable arm with an extension spring that is secured to the adjustable arm by a spring plate and connected to a spring block.

Referring now to FIG. 11, another embodiment of an adjustable arm assembly 350 is shown. The adjustable arm 351 includes an upward facing channel 357 with a width defined, in part, by a medial divide 361*a*. The adjustable arm also includes two additional medial divides 361*b*, 361*c* with different thicknesses that the first medial divide 361*a*. The upward facing channel 357 is configured to receive a pivot aperture block 352 so that it rests on and can be secured to the first medial divide 361*a*. The upward facing channel 357 and the pivot aperture block 352 are dimensioned so that an aperture 353, which is formed through the pivot aperture block 352, is positioned above a top side 370 of the adjustable arm 351 while the pivot aperture block 352 is in the upward facing channel 357. This configuration enables, the aperture 353 to receive a bearing and rotatably secure the adjustable arm assembly 350 to a bottom bar (see, e.g., FIGS. 7A-C) without a bore through the adjustable arm 351.

In some embodiments, other pivot aperture block configurations, including those discussed with reference to FIGS. 1-10, may be used in place of the illustrated pivot aperture block 352. At least one of the medial divides may be different or the same as at least one other medial divide. For example, the first medial divide can be the same thickness as the two additional medial divides, or all three medial divides may have different thicknesses. In some embodiments, at least one medial divide may be positioned closer to, or farther from, the top or bottom of the adjustable arm. In still another embodiment, at least one medial divide may be omitted from an adjustable arm.

As illustrated in FIGS. 12A-13B, an adjustable bottom bar assembly 150 can include an extension spring 152 with a lower end 154 configured to be secured to the adjustable arm 351 and an upper end 156 configured to be secured to the bottom bar 251, thereby linking the bottom bar 251 and the adjustable arm 351. To link the extension spring 152 to the adjustable arm 351, a spring plate 160 is received in the upward facing channel 357 and can be selectively coupled to the first medial divide 361*a*. A slot 162 formed through the spring plate 160 is configured to receive the lower end 154 of the extension spring 152, thereby connecting the extension spring 152 to the top side 370 of the adjustable arm 351. In some embodiments, the lower end 154 of the extension spring 152 includes a portion that extends between the spring plate 160 and the first medial divide 361*a*. When the spring plate 160 is secured to the adjustable arm 301, the lower end 154 of the extension spring 152 is pinned between the spring plate 160 and the first medial divide 361*a* so that it cannot be removed from the slot 162, thereby securing the extension spring 152 to the adjustable arm 351.

To connect the extension spring 152 to the bottom bar 251, its upper end 156 can be selectively secured to a spring block 170. A notch 172 formed through the upper surface of the spring block 170 accommodates a pin 174, which extends across the notch 172 to engage openings 176 formed through opposite sides of the spring block 170. The upper end 156 of the extension spring 152 includes a loop section 158 configured to extend around the pin 174, thereby securing the extension spring 152 to the spring block 170. The downward facing channel 266 of the bottom bar 251 includes two rails 270*a* and 270*b* configured to slidably receive the bottom edge 178 to the spring block 170, thereby enabling the spring block 170 to be inserted into the bottom bar 251 through one of its lateral ends. In the illustrated embodiment, the spring block 170 also includes a bore 180 extending through the front and back sides thereof. The bore 180 can be sized to receive a receive a sleeve bearing, thereby enabling the spring block 170 to be used in place of a pivot block to rotatably secure the adjustable arm 351 to the bottom bar 251. In some embodiments, however, a spring block can be formed without a bore.

In some adjustable bottom bar assemblies, a biasing element other than an extension spring can be used. A biasing element can also be secured to a bottom bar or an adjustable arm using alternative methods. For example, a screw or another fastener can be used to secure the biasing element to the spring plate or the spring block. In some embodiments, a spring plate can be coupled to the adjustable arm in a location other than the upward facing channel, such as the front or back sides of the adjustable arm. A spring plate may also be used to secure the biasing element to the bottom bar. In other embodiments, an adjustable arm can be configured to receive a spring block to secure the biasing element to the adjustable arm. Further still, a biasing element can be coupled to directly to at least one of the adjustable arm or the bottom bar without use of a spring plate or a spring block.

Figure 13A:
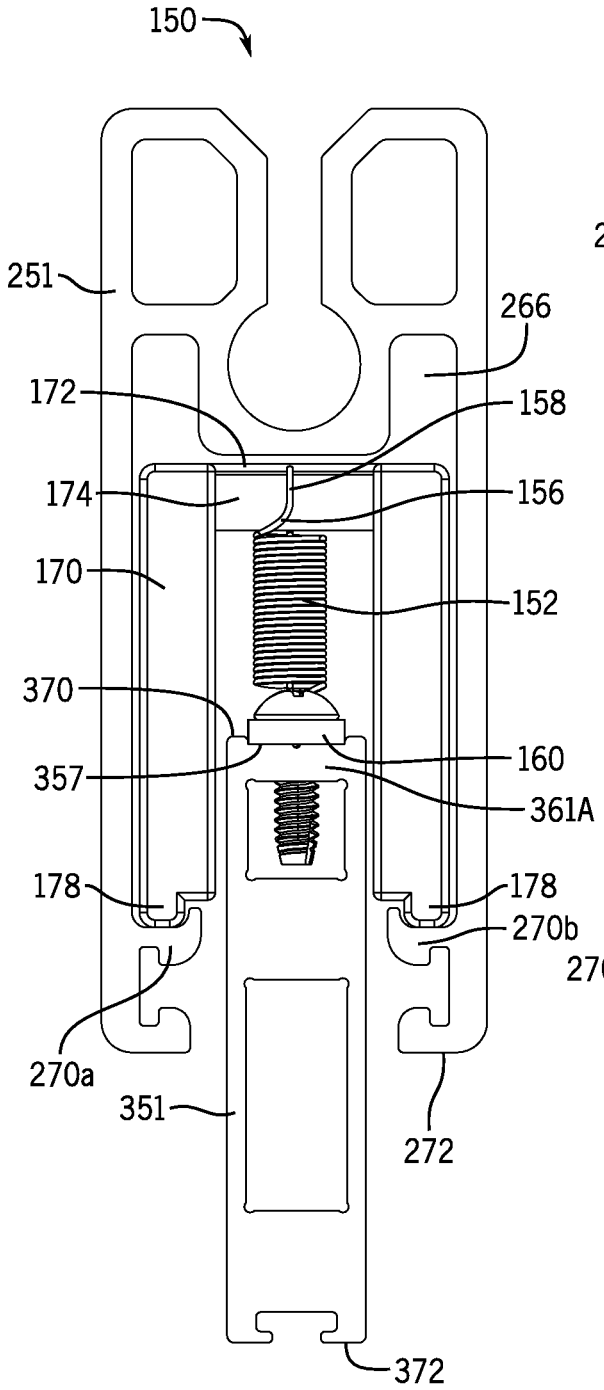
FIG. 13A is a side view of a lateral end of the bottom bar assembly of FIG. 12*b* with the extension spring in the un-extended position.
Figure 13B:
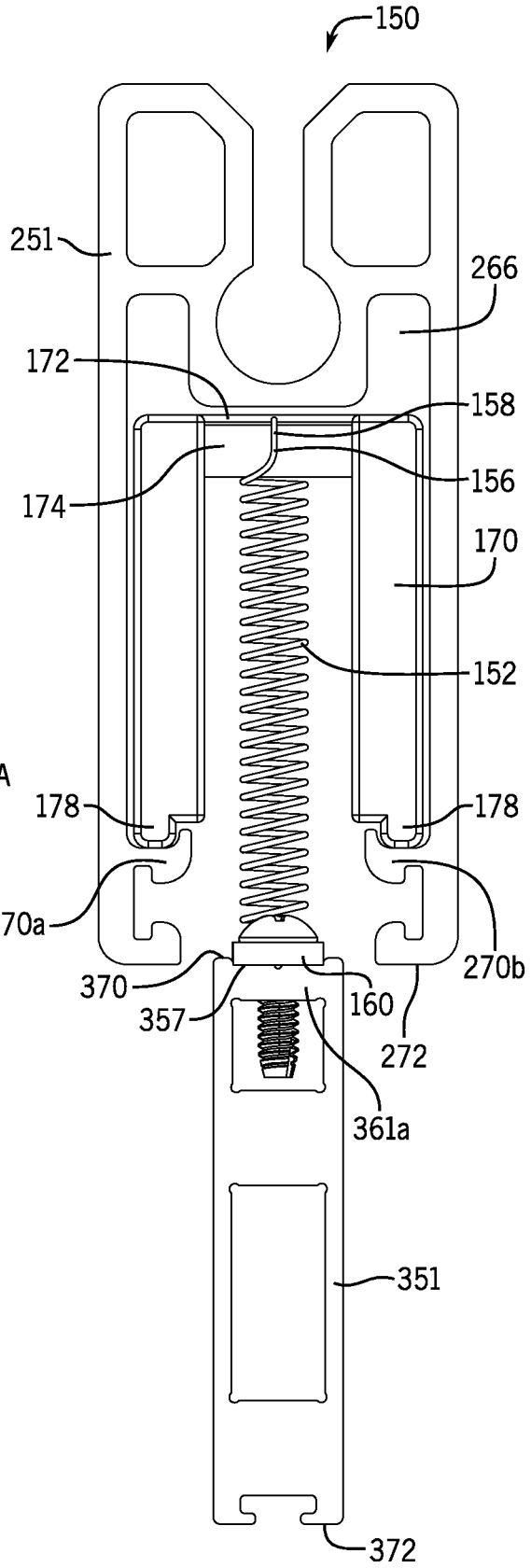
FIG. 13*b* is a side view of a lateral end of the bottom bar assembly of FIG. 12*b* with the extension spring in the extended position.
Figure 14A:
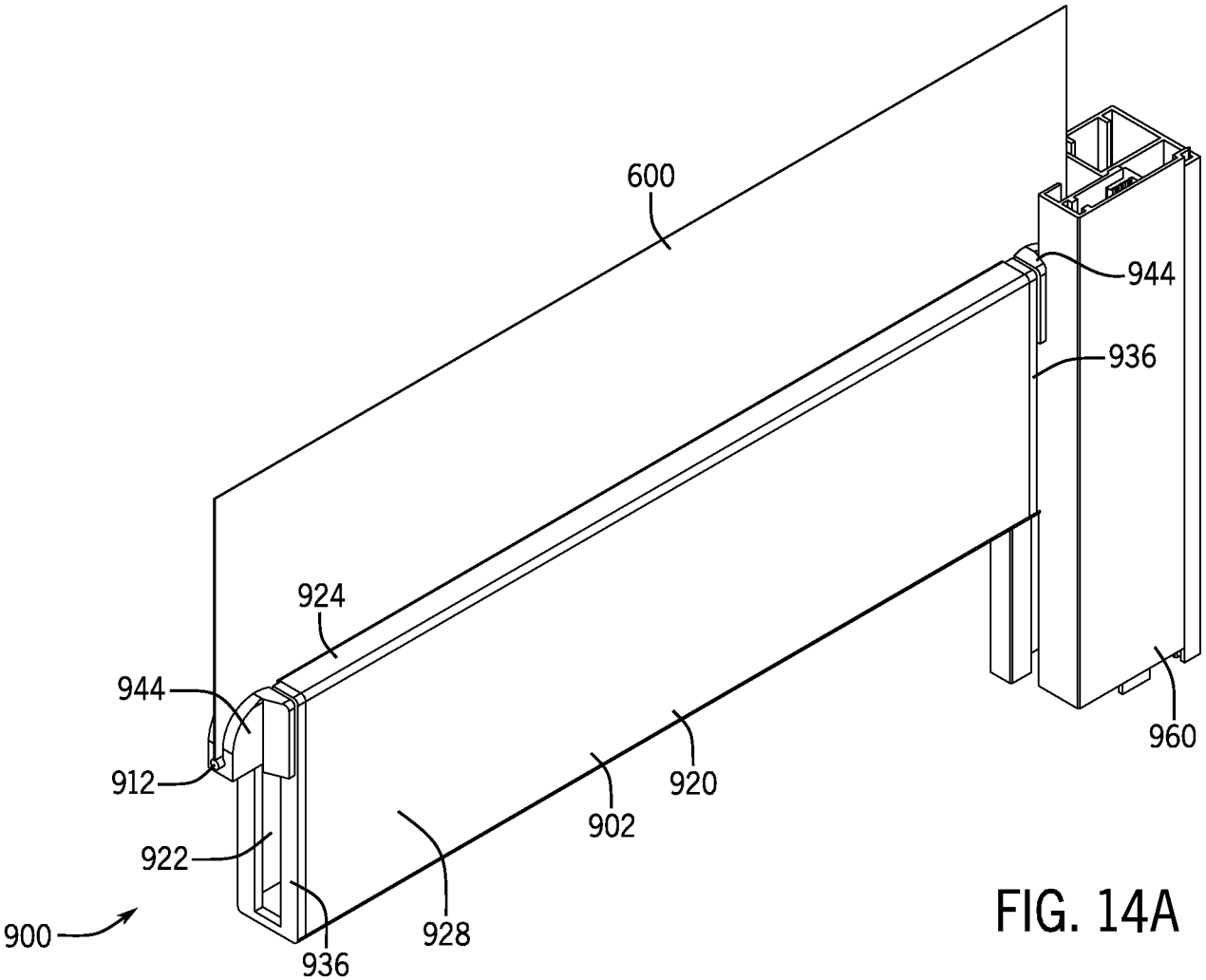
FIG. 14A is a perspective view of an adjustable bottom bar assembly connected to a screen and including an adjustable arm that floats on a bottom bar, and a rail assembly for guiding the adjustable bottom bar assembly.
Figure 14B:
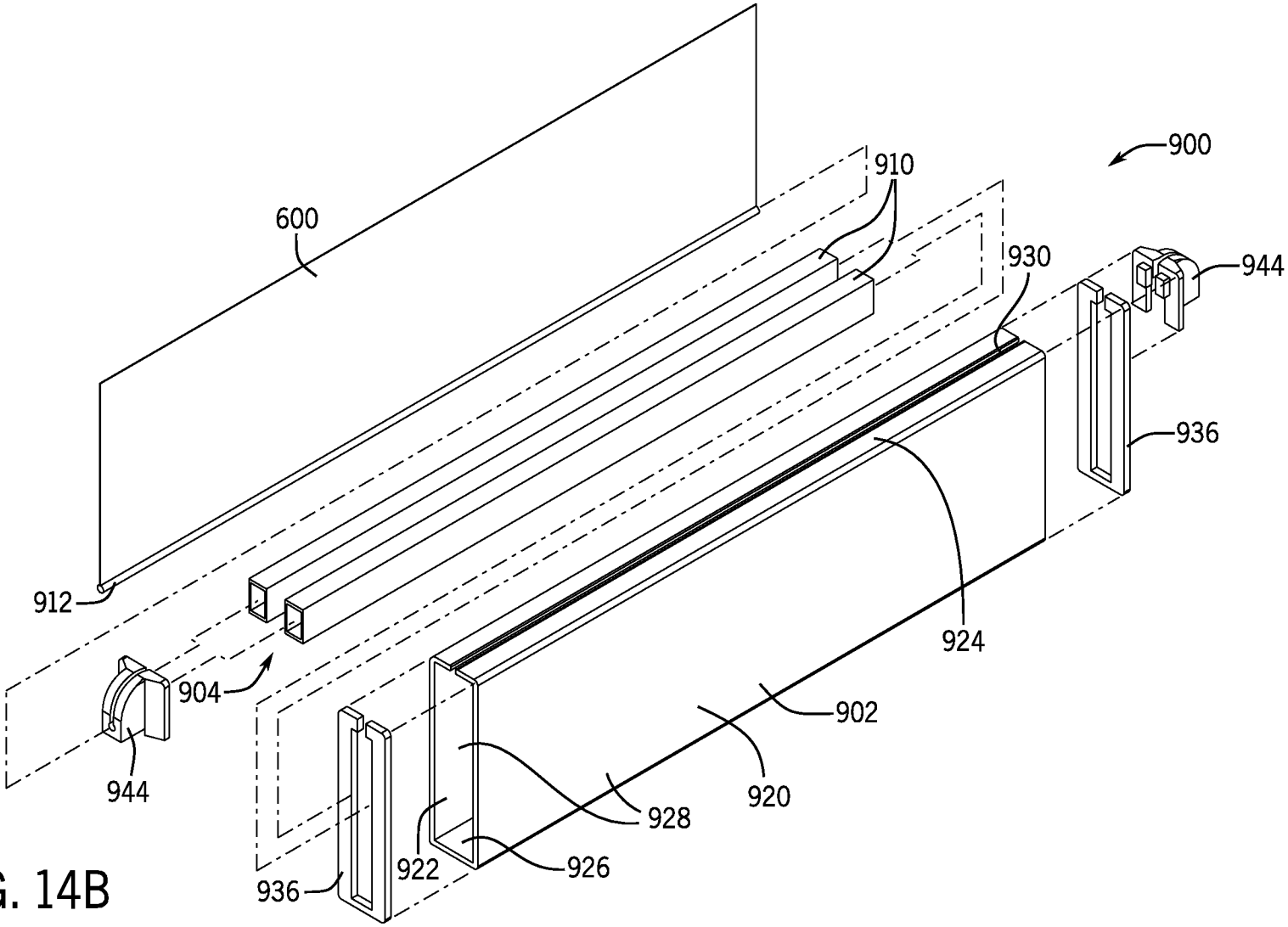
FIG. 14B is an exploded perspective view of the adjustable bottom bar assembly of FIG. 14A.

Returning to the figures, an adjustable bottom bar assembly 150 can be secured to, and extend horizontally along, the bottom edge of a flexible screen (see, e.g., FIGS. 1A and 1B). The adjustable bottom bar assembly 150 includes two extension springs 152 positioned on opposite lateral sides of the pivot point, each extension springs 152 linking the bottom bar 251 and the adjustable arm 351. Specifically, the first extension spring 152 is positioned between first lateral ends of the adjustable arm 351 and the bottom bar 251, and the second extension spring 152 is between second lateral ends of the adjustable arm 351 and the bottom bar 251 opposite the first lateral ends thereof. Each of the extension springs 152 is configured to selectively exert a biasing force on the adjustable arm 351, pulling the end of the adjustable arm 351 to which the extension spring 152 is attached further into the downward facing channel 266, towards the respective lateral end of the bottom bar 251. When an extension spring 152 is in the un-extended position, as shown in FIG. 13A, only a small biasing force (or no biasing force, in some embodiments) is exerted on the adjustable arm 351. When respective lateral end of the adjustable arm 351 is moved away from the bottom bar 251, the extension spring 152 is moved into its extended position, shown in FIG. 13B. In the extended position, the extension springs 152 are configured to apply the biasing force on the adjustable arm 351, pulling the respective lateral end of the adjustable arm 351 up into the downward facing channel 266.

According to one method of using the adjustable bottom bar assembly 150, the first extension spring 152 and the second extension spring are each dimensioned so that the bottom edge 372 of the adjustable arm 351 is parallel to (i.e., level with) the bottom edge 272 of the bottom bar 251 when both of the extension springs 152 are in their un-extended positions. When the screen is lowered towards an uneven surface, the bottom edge 372 of the adjustable arm 351 abuts the uneven surface and is rotated about the pivot point on the bottom bar 251 (to which the adjustable arm 351 is secured) until the bottom edge 372 of the adjustable arm 351 rests on the uneven surface, matching it's slope. As the adjustable arm 351 rotates, the first lateral end of the adjustable arm 351 moves further into the downward facing channel 266 and the second lateral end of the adjustable arm 351 moves out of the downward facing channel 266, thereby extending the second extension spring 152. The first extension spring 152, however, is not extended and, therefore, does not exert a biasing force on the adjustable arm 351 or the bottom bar 251.

While the screen is remains lowered, the normal force applied on the bottom edge 372 of the adjustable arm 351 by the uneven surface is greater than the biasing force applied by the extension spring 152. However, when the screen is raised from the uneven surface, the biasing force applied by the second extension spring 152 is generally unopposed and can pull the second lateral end of the adjustable arm 351 towards the second lateral end of the bottom bar 251. The extension spring 152 continues to bias the adjustable arm 351 until it returns to its resting position in which the adjustable arm 351 is level with the bottom bar 251. Similarly, when the adjustable arm 351 is rotated in the opposite direction (so that the first lateral end of the adjustable arm 351 moves out of the downward facing channel), the first extension spring 152 is configured to provide the biasing force to return the adjustable arm 351 to the resting position.

In order to return adjustable arms of various weights and sizes to the resting position, each extension spring can be selected to provide and appropriate biasing force. The biasing force provided by a spring can be a function of at least one its length, is material composition, or any other factor which may affect the spring's spring constant. The distance between each extension spring and the pivot point may also be adjusted based on the attributes of the adjustable arm. Springs positioned farther from the pivot point will have a larger moment arm and, therefore, may be able to rotate larger or heavier adjustable arms. In one embodiment, the first and second extension springs are respectively positioned two inches away the first and second lateral ends of the adjustable bottom bar assembly. In other embodiments, however, the extension springs may be positioned closer to, or farther away from, the lateral ends of the adjustable bottom bar assembly.

Some embodiments of an adjustable bottom bar assembly can include an adjustable arm that is configured to float on the bottom of a screen without being fixed to the assembly via a pivotable connection. For example, as illustrated in FIGS. 14A-16, an adjustable bottom bar assembly 900 includes an adjustable arm 902 configured to be slidably received on a termination bar 904. The termination bar 904 includes two weighted bars 910 that extend laterally along the front and back sides a flexible screen 600. The weighted bars 910 can be secured to the flexible screen 600 by a mechanical fastener (e.g., a screw or bolt), mutual clamping pressure created by tensioned fasteners, adhesives, or any other method of attachment. A dowel 912 extends along the bottom edge of the flexible screen 600 can help to prevent the weighted bars 910 from moving downward off the flexible screen 600, and/or provide a reference or guide for attaching the weighted bars 910 to the flexible screen 600. The adjustable arm 902 includes a hollow body 920 that defines an interior cavity 922 between a top wall 924, a bottom wall 926 and front and back side walls 928 of the hollow body 920. A vertical slot 930 is formed through the top wall 924 and extends along the length of the hollow body 920 between opposite lateral ends of the adjustable arm 902. In the illustrated embodiment, the two side walls 928 are longer than the top and bottom walls 924, 926 so that the hollow body 920 has a generally rectangular shape. In other embodiments, however, an adjustable arm may be shaped differently than the illustrated adjustable arm.

In some embodiments, an adjustable bottom bar assembly can include only one weighted bar attached to one side of the flexible screen, or a weighted bar can be attached to the bottom edge of the flexible screen and hang below the screen. Some embodiments can use multiple weighted bar segments that are spaced along the length of the flexible screen in place of one or both of the illustrated weighted bars. Similarly, some embodiments of an adjustable bottom bar assembly can use multiple dowel segments in place of the illustrated dowel, or the dowel can be omitted all together. Some embodiments of an adjustable arm can be formed without at least one of the side walls, the bottom wall, or the top wall. While the walls of the hollow body are solid in the illustrated embodiment, other embodiments may have a hollow body with holes, gaps, or missing portions of at least one of the walls.

With continued reference to FIGS. 14A-16, the interior cavity 922 is dimensioned to have a width between interior surfaces of the front and back side walls 928 that is larger than the width of the termination bar 904 so that the termination bar 904 fits within the interior cavity 922. This can help to allow the adjustable arm 902 to slide onto one of the lateral ends of the termination bar 904 so that the weighted bars 910 are received within the interior cavity 922 and the flexible screen 600 extends upward through the vertical slot 930. Once the adjustable arm 902 is received on the bottom bar 904, the adjustable bar 902 is supported by the termination bar 904 and, therefore, hangs from the flexible sheet 600 and the bottom bar 904. The relatively small clearance between the front and back faces of the weighted bars 910 and the side walls 928 of the hollow body 920 limits forward and backwards movement of the adjustable arm 902 relative to the bottom bar 904. End plates 936 can be affixed to the lateral ends of the adjustable arm 902, each one having a central opening and a slot that corresponds to the vertical slot 930 of the adjustable arm 902. Because the width of the central opening of each end plate is less than the width of the bottom bar 904, the body of each end plate 936 covers a portion of the interior cavity 922 and limits lateral motion of the adjustable arm 902 relative to the termination bar 904.

An end plug 944 can also be attached to the lateral ends of the termination bar 904 to limit lateral movement of the adjustable arm 902 relative to the termination bar. Each end plug 944 includes a spacer that extends from the plug body, through the central opening of the respective end plate 936, to the weighted bars 910 to which the end plug 944 is attached. Similarly to the end plates 936, the end plugs 944 include a slot that corresponds to the vertical slot 930 and the flexible screen 600. The end plugs 944 may also include a dowel hole for receiving the dowel 912 attached to the flexible screen 600. In some embodiments, the weighted bars 910 may be hollow and can be configured to receive the spacer to secure the end plug 944 thereto. In other embodiments, the end plugs 944 can be secured to the distal ends of a solid weighted bar. It is contemplated that in certain embodiments, the lateral extent of the weighted bars 910 will be slightly smaller than the lateral extent of fabric 600, and so end plugs 944 serve to cover the lateral-most ends of fabric 600.

Figure 15A:
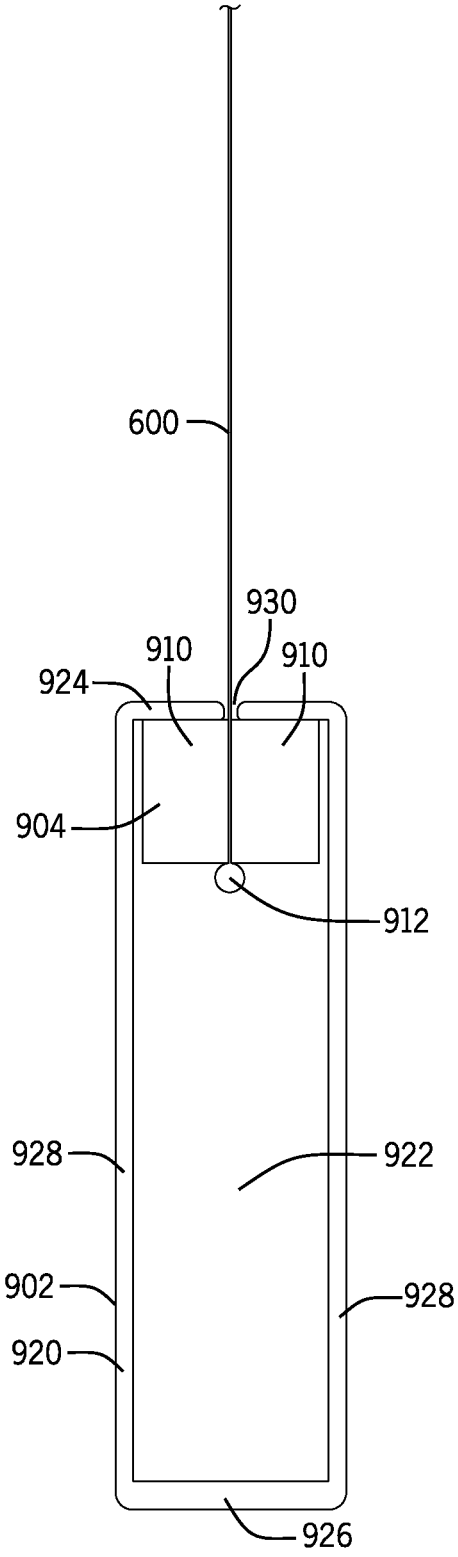
FIG. 15A is a cross sectional side view of the adjustable bottom bar assembly of FIG. 14A with the adjustable arm in the level position.
Figure 15B:
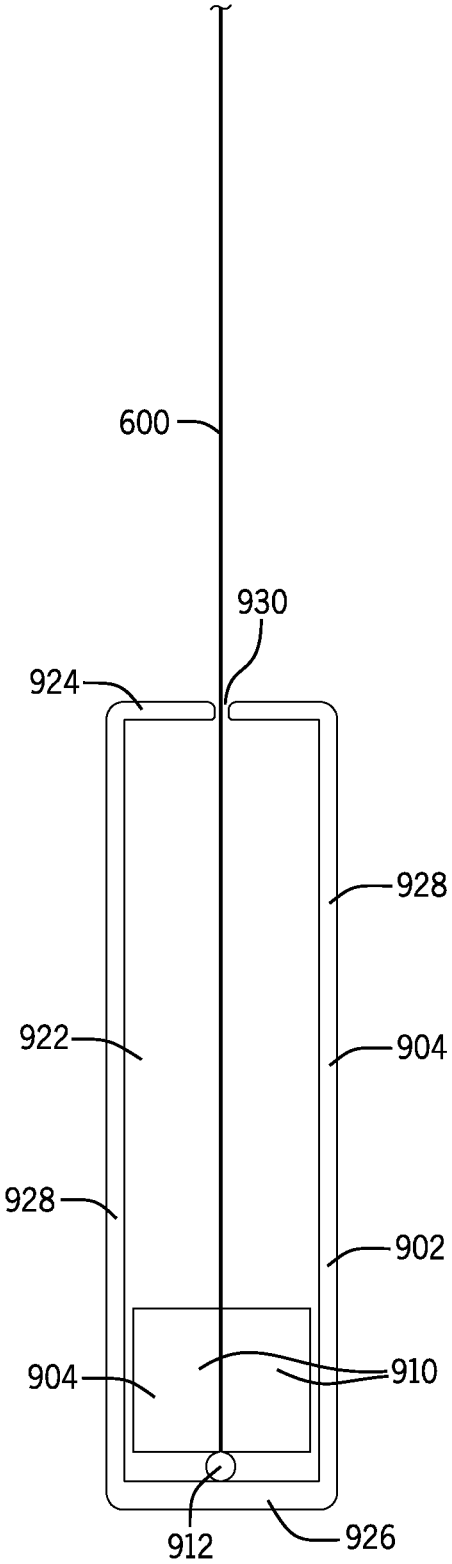
FIG. 15B is a cross sectional side view of the adjustable bottom bar assembly of FIG. 14A with the adjustable arm in a fully-raised level position.

As previously discussed, the adjustable arm 902 is generally rectangular and elongated in the vertical direction. On the other hand, the cross section of termination bar 904 is generally square shaped, with the height of the termination bar 904 being substantially the same (or, in some embodiments, only similar to) its width. The difference in the heights of the interior cavity 922 and the termination bar 904 provide ample space for the adjustable arm 902 to move vertically with respect to the termination bar 904. While in the level position, the adjustable arm 902 hangs on the termination bar 904 with the lower sides of the top wall 924 abutting the top faces of the weighted bars 910 (see, e.g., FIG. 15A). In this position, the bottom edge of the adjustable arm 902 is level with the termination bar 904 and the bottom edge of the flexible screen 600, will of those surfaces being level in an optimal installation. The adjustable arm 902 can be pushed upward off of the termination bar 904 and out of the level position, and can continue to move upwards until the dowel 912 (or the bottom faces of the weight bars 910) abuts the bottom wall 926 of the hollow body 922. FIG. 15B illustrates an example of an adjustable arm 902 in the fully-raised position. Although the end plates 936 and the end plugs 944 limit lateral movement of the adjustable arm 902, sufficient clearance is provided between the lateral ends of the termination bar 904 and the end plates 936 and the end plates 936 (or the lateral ends of the adjustable arm 902) and the end plugs 944, respectively, that uneven vertical movement (i.e., tilt) of the adjustable arm 902 is possible. One lateral end of the adjustable arm 902 can be moved a first vertical distance from the bottom bar 904 while the opposite lateral end of the adjustable arm either remains stationary and rests on the top of the termination bar 904, or moves a second vertical distance from the bottom bar 904, which may be greater than or less than the first. When the adjustable arm 902 is unevenly pushed vertically, it is moved into the rotated position in which the bottom edge of the adjustable arm 902 forms an oblique angle relative to the termination bar 904 and the bottom edge of the flexible screen 600.

As with the other adjustable arms described above, adjustable arm 902 may optionally include a short strip of felt or some other flexible material along a bottom facing surface of bottom wall 926 for the purpose of creating a seal with the floor. It will be appreciated that in the inventive embodiments, the height of the felt need not be as tall as for conventional solutions to the uneven floor problem, since the rotating adjustable arm conforms to the angle of the floor. Some flexible material, however, is advantageous to provide a final seal and to prevent hard surface contact between arm 901 and the floor.

Figure 16:
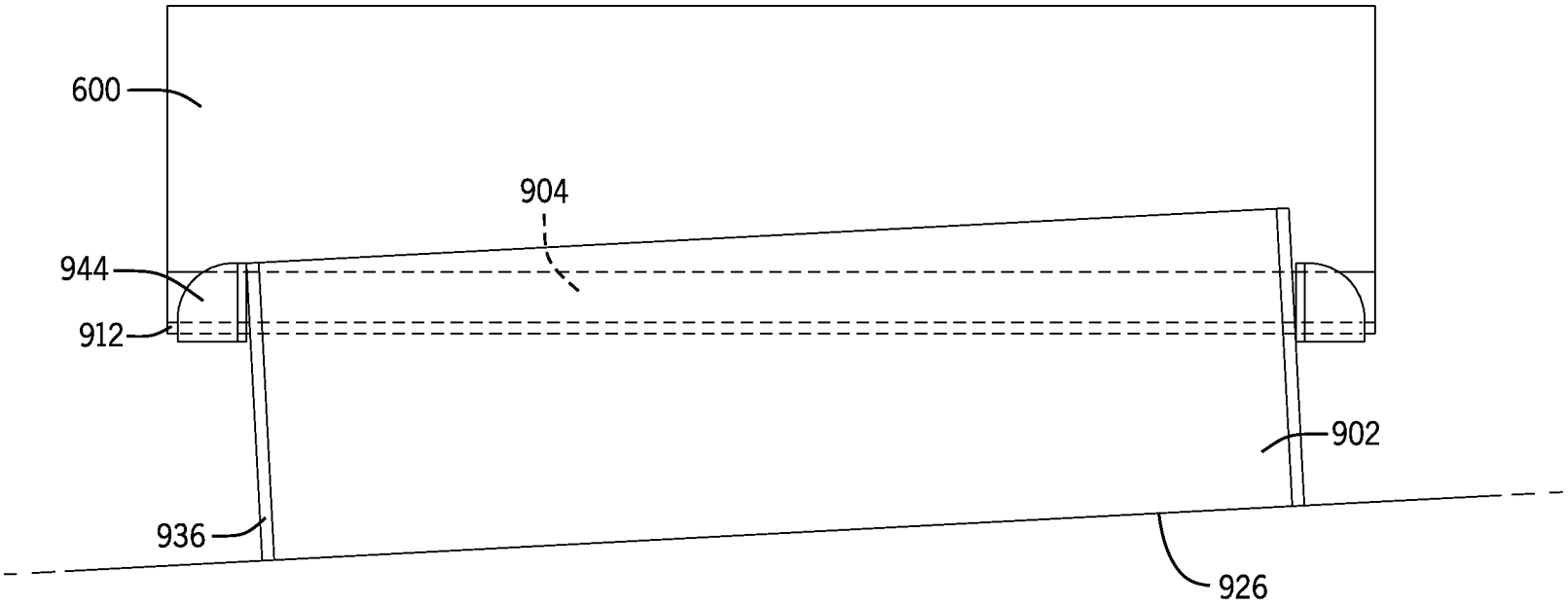
FIG. 16 is a front view of the adjustable bottom bar assembly and screen of FIG. 14A where the screen is in a lowered position and the adjustable arm is in a rotated position.

Accordingly, the adjustable bottom bar assembly 900 can be used as a self-adjusting bottom bar for a retractable screen. While the flexible screen 600 is raised, the adjustable arm 902 is configured to hang in the level position. But when the flexible screen 600 is lowered towards a non-level surface, the bottom wall 926 of the adjustable arm 902 will eventually contact the higher side of uneven surface, thereby lifting the respective lateral end of the adjustable arm 902 off of the termination bar 904 while the opposite lateral end (which corresponds to the lower side of the non-level surface) remains resting on the termination bar 904. As illustrated in FIG. 16, the adjustable arm 902 will continue to rotate until the bottom wall 926 is resting on, and therefore parallel to, the non-level surface. When the flexible screen 600 is raised away from the uneven surface, the weight of the adjustable arm 902 moves it out of the rotated position and back into the level position.

In some embodiments, the end plugs 944 can also include a fin extending from the plug body in a direction opposite the spacer. Where one is included, the fin can be configured to engage a rail assembly 960 in order to guide the movement of the adjustable bottom bar assembly 900 as the flexible screen 600 is raised and lowered (see, e.g., FIG. 14A). In other embodiments, the fin may be omitted from at least one end plug and no rail assembly may be provided. Some embodiments of an adjustable bottom bar assembly may omit at least one end plug or end plate. At least one of the end plugs or end plates may be formed without at least one of the feature that is different than those of the illustrated end plugs and end plates. Further, in some embodiments, an end plug can be secured to an adjustable arm instead of the bottom bar.

While the preferred embodiments of the present invention have been illustrated in detail, it should be apparent that modifications and adaptations to those embodiments may occur to one skilled in the art without departing from the scope of the present invention.

The invention as recited in claims appended to this disclosure is intended to be assessed in light of the disclosure as a whole.

What is claimed is:

1. A retractable screen system, comprising:

a sheet of planar screen material;

a bottom bar assembly including an adjustable arm extending horizontally along a bottom edge of the sheet of planar screen material, wherein the adjustable arm is configured to rotate about an axis that is perpendicular to the plane of the screen material, wherein the bottom bar assembly and the adjustable arm each include magnets arranged to magnetically engage one another when the adjustable arm is in a predetermined position with respect to the bottom bar, and arranged to exert magnetic force between the bottom bar assembly and the adjustable arm to cause the adjustable arm to magnetically resist translation and rotation with respect to the bottom bar.

2. The screen system of claim 1, wherein the adjustable arm is pivotably fixed to the sheet of planar screen material.

3. The system of claim 1, wherein the screen material is flexible.

4. The system of claim 1, wherein the adjustable arm comprises a downwardly facing edge including a strip of flexible material.

5. The screen system of claim 1, wherein the adjustable arm is further configured to translate vertically with respect to bottom edge of the sheet of planar screen material, within a predetermined range, when vertical force is applied to the adjustable arm.

6. The screen system of claim 5, wherein the adjustable arm hangs from a bottom region of the sheet of planar screen material when there is no force acting on the adjustable arm in an upward direction.

7. The screen system of claim 1, wherein the system is a retractable screen system having a bottom edge configured to be raised from and lowered into contact with a floor, and wherein, when the adjustable arm has a bottom edge that defines the bottom edge of the screen system.

8. The screen system of claim 7, wherein the adjustable arm is level when the screen system has been retracted such that the adjustable arm is not in contact with the floor.

9. The screen system of claim 8, wherein the screen system includes one or more biasing elements that exert vertical force on the adjustable arm, the amount and location of the vertical force being sufficient to bring the adjustable arm to level when the adjustable arm is not in contact with the floor.

10. The system of claim 1, further including a pair of vertically arranged rail assemblies defining inwardly facing vertical channels.

11. The system of claim 10, wherein the adjustable arm includes a pair of outwardly extending fins arranged at a first and second ends of the adjustable arm, the fins sized to be received in and translate vertically within said channels.

* * * * *